US011694622B1

(12) United States Patent
Liu et al.

(10) Patent No.: US 11,694,622 B1
(45) Date of Patent: Jul. 4, 2023

(54) PIXEL CIRCUIT, METHOD FOR DRIVING THE PIXEL CIRCUIT AND DISPLAY PANEL

(71) Applicant: SeeYa Optronics, Ltd., Shanghai (CN)

(72) Inventors: Ping-Lin Liu, Shanghai (CN); Tong Wu, Shanghai (CN)

(73) Assignee: SeeYa Optronics, Ltd., Shanghai (CN)

( * ) Notice: Subject to any disclaimer, the term of this patent is extended or adjusted under 35 U.S.C. 154(b) by 0 days.

(21) Appl. No.: 17/943,081

(22) Filed: Sep. 12, 2022

(30) Foreign Application Priority Data

Dec. 27, 2021 (CN) ..... 202111611893.X

(51) Int. Cl.
*G09G 3/3233* (2016.01)

(52) U.S. Cl.
CPC ... *G09G 3/3233* (2013.01); *G09G 2300/0426* (2013.01); *G09G 2300/0465* (2013.01); *G09G 2300/0819* (2013.01); *G09G 2300/0852* (2013.01); *G09G 2300/0861* (2013.01); *G09G 2310/0278* (2013.01); *G09G 2320/0233* (2013.01); *G09G 2330/023* (2013.01)

(58) Field of Classification Search
CPC ..... G09G 3/3233; G09G 2300/0426; G09G 2300/0465; G09G 2300/0819; G09G 2300/0852; G09G 2300/0861; G09G 2310/0278; G09G 2320/0233; G09G 2330/023
See application file for complete search history.

(56) References Cited

U.S. PATENT DOCUMENTS

2021/0158755 A1* 5/2021 Li ..... G09G 3/3266
2023/0013661 A1* 1/2023 Beard ..... G09G 3/3233

* cited by examiner

*Primary Examiner* — Robert J Michaud
(74) *Attorney, Agent, or Firm* — Wolf, Greenfield & Sacks, P.C.

(57) ABSTRACT

Provided are a pixel circuit, a method for driving the pixel circuit, and a display panel. The pixel circuit includes a drive transistor including a gate terminal, a source terminal, a drain terminal, and a body terminal, where the source terminal is connected to a first power line, the body terminal is connected to a second power line, and the gate terminal of the drive transistor is connected to a gate potential control circuit; the first power line is configured to provide a first voltage or a second voltage, where the first voltage is higher than the second voltage; and the second power line is configured to provide the fixed first voltage.

20 Claims, 11 Drawing Sheets

PIXEL CIRCUIT, METHOD FOR DRIVING THE PIXEL CIRCUIT AND DISPLAY PANEL

CROSS-REFERENCE TO RELATED APPLICATION(S)

This application claims priority to Chinese Patent Application No. 20211611893.X filed Dec. 27, 2021, the disclosure of which is incorporated herein by reference in its entirety.

TECHNICAL FIELD

The present disclosure relates to the field of display technology and, in particular, to a pixel circuit, a method for driving the pixel circuit, and a display panel.

BACKGROUND

With the development of display technology, display panels are more and more widely applied. Accordingly, increasingly high requirements are imposed on the power consumption and the display effects of the display panels.

At present, when a pixel circuit in the related art is initialized, a relatively large current flows through a drive transistor so that the pixel circuit has relatively large power consumption and customer requirements cannot be satisfied.

SUMMARY

The present disclosure provides a pixel circuit, a method for driving the pixel circuit, and a display panel, so as to solve the problem of excessive large power consumption of a pixel circuit during initialization.

In a first aspect, the present disclosure provides a pixel circuit including a drive transistor. The drive transistor includes a gate terminal, a source terminal, a drain terminal, and a body terminal. The source terminal of the drive transistor is connected to a first power line, the body terminal of the drive transistor is connected to a second power line, and the gate terminal of the drive transistor is connected to a gate potential control circuit. The first power line is configured to provide a first voltage or a second voltage, where the first voltage is higher than the second voltage; and the second power line is configured to provide the fixed first voltage. An initialization stage of the pixel circuit includes a first time period and a second time period. In the first time period, a voltage provided by the first power line is decreased from the first voltage to the second voltage, a threshold voltage of the drive transistor is increased from a first threshold voltage to a second threshold voltage, and the gate potential control circuit controls a voltage of the gate terminal to be decreased such that the drive transistor is turned off.

In the second time period, the voltage provided by the first power line is increased from the second voltage to the first voltage, the threshold voltage of the drive transistor is decreased from the second threshold voltage to the first threshold voltage, and the gate potential control circuit controls the voltage of the gate terminal of the drive transistor to be increased such that the drive transistor is turned on. An increase of the voltage of the gate terminal of the drive transistor in the second time period is smaller than a decrease of the voltage of the gate terminal in the first time period.

Optionally, the gate potential control circuit includes a first capacitor and a connection transistor, where a second terminal of the first capacitor and a first electrode of the connection transistor are connected to the gate terminal of the drive transistor, and a second electrode of the connection transistor is connected to the drain terminal of the drive transistor. In the first time period, the gate potential control circuit controls a potential of the gate terminal of the drive transistor to be the same as a potential of the drain terminal of the drive transistor.

Optionally, the first voltage is a power voltage for light emission and display of the pixel circuit.

Optionally, the pixel circuit further includes a voltage gating circuit configured to gate the first voltage or the second voltage transmitted by the first power line. The voltage gating circuit includes a first switch transistor and a second switch transistor; where the first switch transistor includes a first terminal for receiving the first voltage, a second terminal connected to the first power line, and a control terminal connected to a first switch control signal line; and the second switch transistor includes a first terminal for receiving the second voltage, a second terminal connected to the first power line, and a control terminal connected to a second switch control signal line.

Optionally, a pulse of a second switch control signal is located within an interval where a pulse of a first switch control signal is located.

Optionally, a first terminal of the first capacitor is connected to the first power line; or a first terminal of the first capacitor is connected to the second power line providing the fixed first voltage.

Optionally, the pixel circuit further includes a light emission control transistor, a light-emitting element, a second capacitor, and a data writing transistor; where the light emission control transistor includes a first electrode connected to the drain terminal and a second electrode connected to an anode of the light-emitting element; the second capacitor includes a first terminal connected to the gate terminal and a second terminal connected to a first electrode of the data writing transistor; and a fixed voltage signal is input to a second electrode of the data writing transistor at the initialization stage.

Optionally, at the initialization stage, the light emission control transistor operates in a cutoff region, a saturation region, or a linear region.

Optionally, in the first time period, after the voltage provided by the first power line is decreased from the first voltage to the second voltage, the connection transistor delays being turned on such that the potential of the gate terminal of the drive transistor is the same as the potential of the drain terminal of the drive transistor.

Optionally, in the first time period, after the voltage provided by the first power line is decreased from the first voltage to the second voltage, the data writing transistor delays being turned on such that the potential of the gate terminal of the drive transistor is decreased.

In a second aspect, the present disclosure further provides a display panel including the preceding pixel circuit.

Optionally, the display panel includes a display region and a non-display region surrounding the display region, and the pixel circuit further includes a voltage gating circuit disposed in the non-display region and configured to gate a first voltage or a second voltage transmitted by a first power line.

Optionally, a plurality of pixels in a same row share the voltage gating circuit.

Optionally, the display panel is a silicon-based organic light-emitting micro display panel.

In a third aspect, the present disclosure further provides a method for driving a pixel circuit. The pixel circuit includes a drive transistor, where the drive transistor includes a gate terminal, a source terminal, a drain terminal, and a body terminal; the source terminal of the drive transistor is connected to a first power line, and the gate terminal of the drive transistor is connected to a gate potential control circuit; the first power line is configured to provide a first voltage or a second voltage, where the first voltage is higher than the second voltage; and a second power line is configured to provide the fixed first voltage.

The method for driving a pixel circuit includes steps described below.

An initialization stage of the pixel circuit includes a first time period and a second time period.

In the first time period, a voltage of the source terminal of the drive transistor is decreased from the first voltage to the second voltage, a voltage of the body terminal is maintained to be the first voltage, a threshold voltage of the drive transistor is increased from a first threshold voltage to a second threshold voltage, and the gate potential control circuit controls a voltage of the gate terminal to be decreased such that the drive transistor is turned off.

In the second time period, the voltage of the source terminal of the drive transistor is increased from the second voltage to the first voltage, the voltage of the body terminal is maintained to be the first voltage, the threshold voltage of the drive transistor is decreased from the second threshold voltage to the first threshold voltage, and the gate potential control circuit controls the voltage of the gate terminal of the drive transistor to be increased such that the drive transistor is turned on.

An increase of the voltage of the gate terminal of the drive transistor in the second time period is smaller than a decrease of the voltage of the gate terminal in the first time period such that the gate terminal is initialized.

Optionally, the gate potential control circuit includes a first capacitor and a connection transistor, where a second terminal of the first capacitor and a first electrode of the connection transistor are connected to the gate terminal of the drive transistor, and a second electrode of the connection transistor is connected to the drain terminal of the drive transistor.

The method for driving a pixel circuit includes that in the first time period, the gate potential control circuit controls a potential of the gate terminal of the drive transistor to be the same as a potential of the drain terminal of the drive transistor.

Optionally, the pixel circuit further includes a light emission control transistor and a light-emitting element. The light emission control transistor includes a first electrode connected to the drain terminal of the drive transistor and a second electrode connected to an anode of the light-emitting element.

The method for driving a pixel circuit includes: in the first time period, controlling the light emission control transistor to operate in a cutoff region and the connection transistor to be turned on such that the potential of the gate terminal of the drive transistor is the same as the potential of the drain terminal of the drive transistor.

Optionally, the pixel circuit further includes a light emission control transistor and a light-emitting element. Where the light emission control transistor includes a first electrode connected to the drain terminal of the drive transistor and a second electrode connected to an anode of the light-emitting element.

The method for driving a pixel circuit includes: in the first time period, controlling the light emission control transistor to operate in a saturation region such that the drain terminal of the drive transistor is discharged through the light emission control transistor, and controlling the connection transistor to operate in a linear region such that the potential of the gate terminal of the drive transistor is the same as the potential of the drain terminal of the drive transistor.

Optionally, the pixel circuit further includes a light emission control transistor and a light-emitting element; where the light emission control transistor includes a first electrode connected to the drain terminal of the drive transistor and a second electrode connected to an anode of the light-emitting element.

The method for driving a pixel circuit includes: in the first time period, controlling the light emission control transistor to operate in a linear region such that a voltage difference between the drain terminal of the drive transistor and the anode of the light-emitting element is a threshold voltage of the light-emitting element, and controlling the connection transistor to be turned on such that the potential of the gate terminal of the drive transistor is the same as the potential of the drain terminal of the drive transistor.

Optionally, in the first time period, after the voltage of the source terminal of the drive transistor is decreased from the first voltage to the second voltage, the connection transistor delays being turned on.

Optionally, in the first time period, when the voltage of the source terminal of the drive transistor is decreased from the first voltage to the second voltage, a voltage of a first terminal of a first capacitor is decreased from the first voltage to the second voltage or is maintained to be the first voltage.

Optionally, the method for driving a pixel circuit further includes a threshold detection stage, a data writing stage, and a light emission stage after the initialization stage.

According to the technical solutions provided by embodiments of the present disclosure, at the initialization stage, a potential difference between the source terminal and the body terminal of the drive transistor is controlled such that the threshold voltage of the drive transistor is changed from the first threshold voltage to the second threshold voltage, so as to turn off the drive transistor. Then, a potential of the source terminal of the drive transistor is controlled to be restored to an initial potential such that the source terminal and the body terminal have the same potential, and the threshold voltage of the drive transistor is restored to the first threshold voltage, so as to turn on the drive transistor. In other words, the potentials of the source terminal and the body terminal of the drive transistor are controlled and a threshold voltage hysteresis is generated through a substrate effect of the drive transistor so that the threshold voltage of the drive transistor is changed from the first threshold voltage to the second threshold voltage and then restored to the first threshold voltage. During the threshold voltage hysteresis, a potential of a control terminal of the drive transistor is changed, so as to initialize the potential of the control terminal of the drive transistor. In the initialization process, the drive transistor is in an off state, and no current flows through the drive transistor. Therefore, the power consumption of the pixel circuit can be reduced, thereby reducing the power consumption of the display panel. Additionally, the pixel circuit provided by the embodiments of the present disclosure does not need to be provided with an initialization transistor, reducing the number of transistors and facilitating the improvement of pixels per inch (PPI).

DETAILED DESCRIPTION

Figure 1:
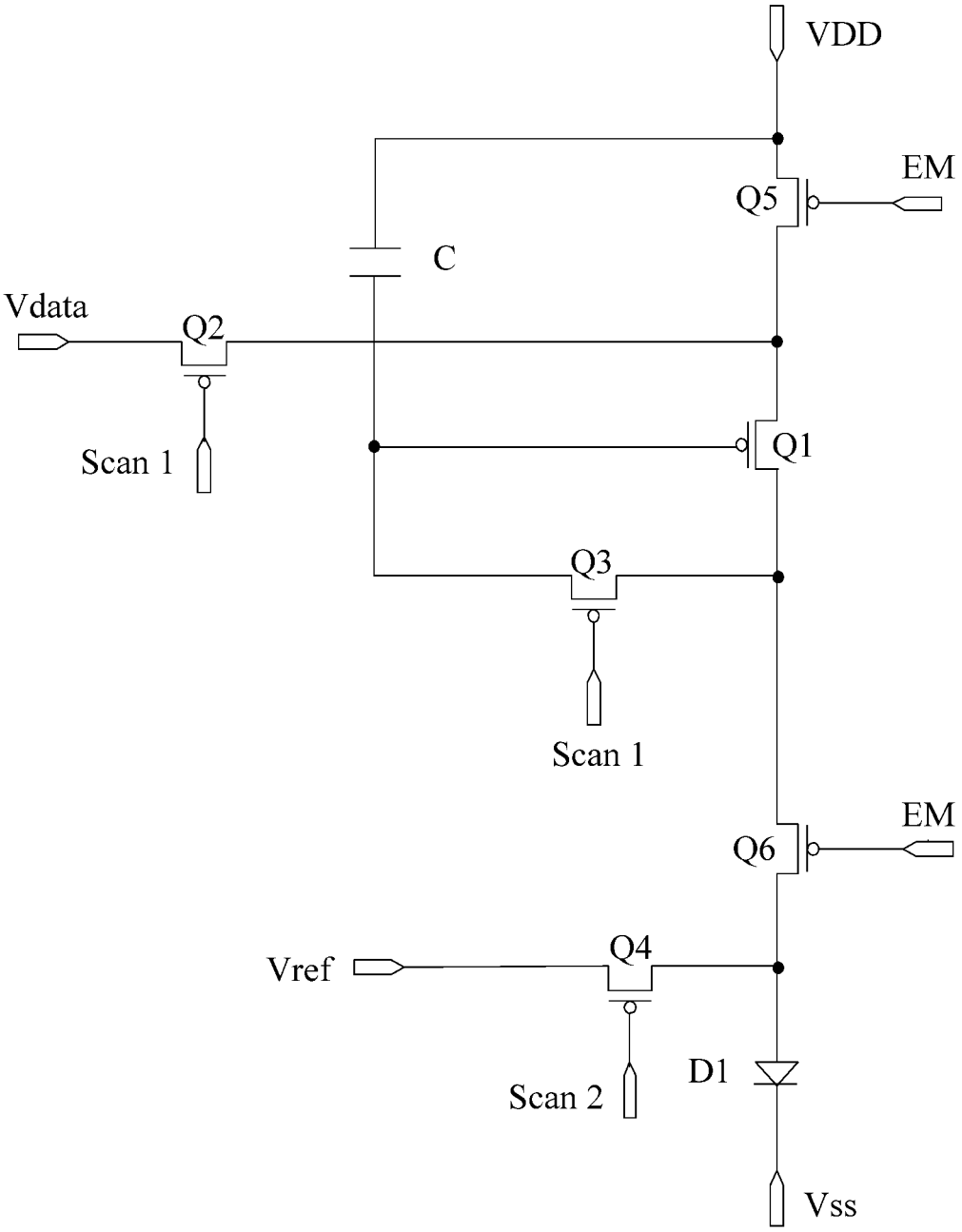
FIG. 1 is a structure diagram of a pixel circuit in the related art.

The present disclosure is further described hereinafter in detail in conjunction with drawings and embodiments. It is to be understood that the embodiments described herein are intended to explain the present disclosure and not to limit the present disclosure. Additionally, it is to be noted that for ease of description, only part, not all, of the structures related to the present disclosure are illustrated in the drawings.

FIG. 1 is a structure diagram of a pixel circuit in the related art. Referring to FIG. 1, during the initialization of the pixel circuit, a second transistor Q2 is turned off, a third transistor Q3, a fourth transistor Q4, a fifth transistor Q5, and a sixth transistor Q6 are turned on, and an initialization voltage Vref is written to a gate of a first transistor Q1 through the fourth transistor Q4, the sixth transistor Q6, and the third transistor Q3 to initialize a potential of the gate of the first transistor Q1. Since the fifth transistor Q5 and the sixth transistor Q6 are turned on, a path is formed through the fifth transistor Q5, the first transistor Q1, the sixth transistor Q6, and the fourth transistor Q4, and a large current flows from a terminal VDD to a terminal Vref. That is, a large current flows through the first transistor Q1, which increases the power consumption of the pixel circuit. Moreover, a large number of transistors are disposed in the pixel circuit, which is unfavorable for a display device to achieve a small size and a high resolution. In other pixel circuits in the related art, a transistor connected in parallel to an anode of a light-emitting element OLED is not provided so that the current cannot be introduced into a bypass circuit. If other manners are used, a current might flow through the light-emitting element OLED so that the light-emitting element OLED emits light, reducing a display contrast.

In terms of the preceding problems, embodiments of the present disclosure provide a pixel circuit applicable to those pixel circuits including metal-oxide-semiconductor (MOS) devices having body terminals. A threshold voltage hysteresis is generated by a substrate effect of an MOS transistor so that a gate of a drive transistor is initialized, which may solve the problem of excessive large power consumption during the initialization of the pixel circuit without reducing a display effect. Moreover, a small number of transistors are used, which is suitable for miniaturization.

Figure 2:
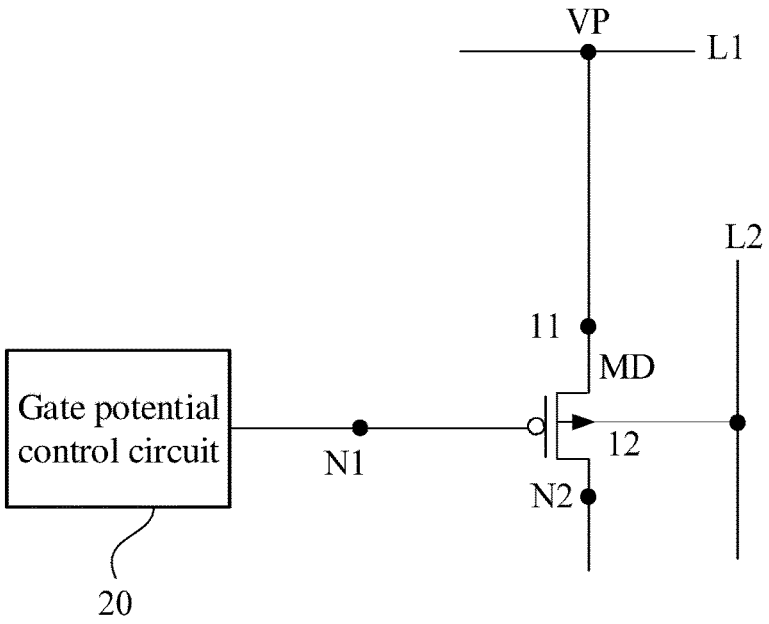
FIG. 2 is a structure diagram of a pixel circuit according to an embodiment of the present disclosure.
Figure 3:
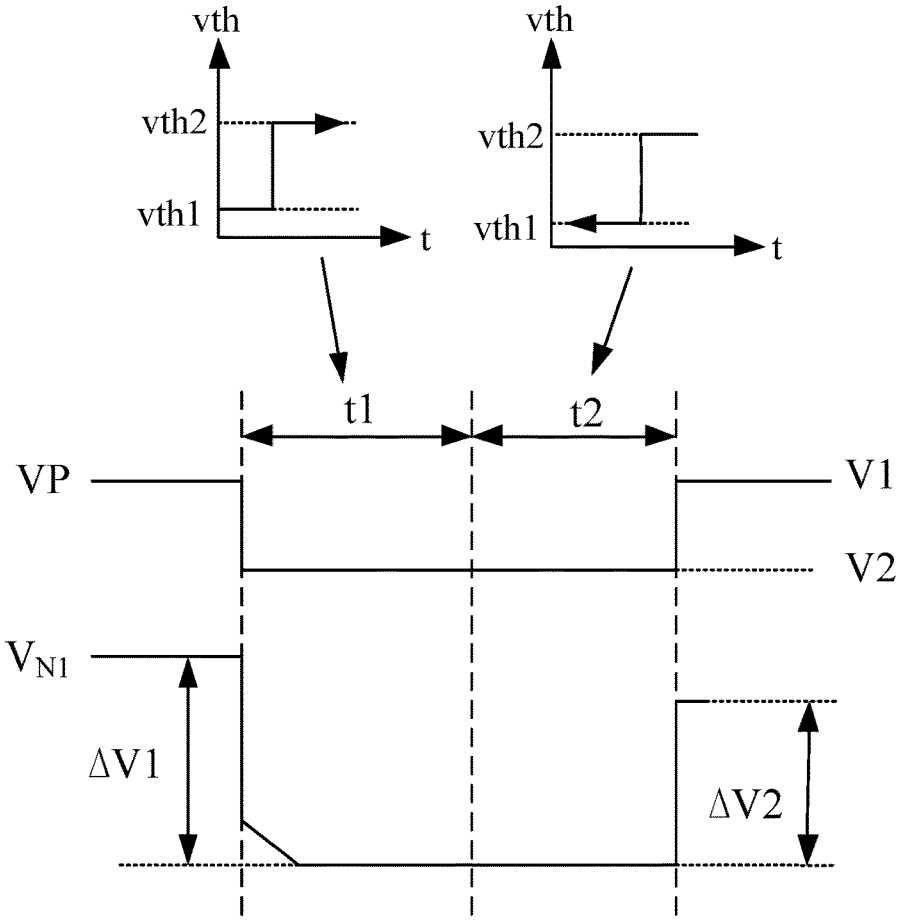
FIG. 3 is a schematic diagram showing changes of a voltage on a first power line, a threshold voltage of a drive transistor, and a voltage of a gate terminal of the drive transistor at an initialization stage of a pixel circuit according to an embodiment of the present disclosure.

FIG. 2 is a structure diagram of a pixel circuit according to an embodiment of the present disclosure. FIG. 3 is a schematic diagram showing changes of a voltage on a first power line, a threshold voltage of a drive transistor, and a voltage of a gate terminal of the drive transistor at an initialization stage of a pixel circuit according to an embodiment of the present disclosure. Referring to FIGS. 2 and 3, the pixel circuit provided by the embodiments of the present disclosure includes a drive transistor MD, where the drive transistor MD is a MOS transistor having at least four terminals and at least includes a gate terminal N1, a source terminal 11, a drain terminal N2, and a body terminal 12. The source terminal 11 of the drive transistor MD is connected to a first power line L1, the body terminal 12 of the drive transistor MD is connected to a second power line L2, and the gate terminal N1 of the drive transistor MD is connected to a gate potential control circuit 20. The first power line L1 is configured to provide a voltage VP which is a first voltage V1 or a second voltage V2, where the first voltage V1 is higher than the second voltage V2. The second power line L2 is configured to provide the first voltage V1 which is fixed. The gate potential control circuit 20 is configured to control a voltage of the gate terminal N1 of the drive transistor MD according to the voltage provided by the first power line L1 to initialize the gate terminal N1.

It is to be noted that in a conventional display device, a thin-film transistor switch is generally used, which is a three-terminal device and whose threshold voltage is related to merely the manufacturing process and free from an effect of an electrical setting. The MOS transistor which is a device with at least four terminals is used as the drive transistor in the present disclosure. A bias voltage at a body terminal of the MOS transistor changes the threshold voltage of the MOS transistor, which is referred to as a substrate effect. In general cases of circuit manufacturing, the substrate effect is a negative effect, and it is necessary to eliminate the substrate effect. Otherwise, circuit characteristics will be changed due to a variation of the threshold voltage of the MOS transistor. However, in the present disclosure, the gate terminal of the drive transistor is initialized through the substrate effect of the drive transistor.

Specifically, an initialization stage of the pixel circuit includes a first time period t1 and a second time period t2. In the first time period t1, the voltage VP provided by the first power line L1 is decreased from the first voltage V1 to the second voltage V2. Since the fixed first voltage V1 is provided to the body terminal 12 of the drive transistor MD, a voltage of the source terminal 11 of the drive transistor MD is different from a voltage of the body terminal 12 of the drive transistor MD, which is equivalent to a bias voltage is applied to the body terminal 12 of the drive transistor MD. Thus, the substrate effect of the drive transistor MD is enhanced and the threshold voltage Vth of the drive transistor MD is increased from a first threshold voltage Vthl to a second threshold voltage Vth2. At the same time, the gate potential control circuit 20 controls the voltage of the gate terminal N1 of the drive transistor MD to be decreased such that the drive transistor MD is turned off.

Specifically, when the body terminal 12 and the source terminal 11 of the drive transistor MD have the same potential, the threshold voltage Vth of the drive transistor MD is equal to the first threshold voltage Vth1. If the body terminal 12 and the source terminal 11 have different potentials, the substrate effect of the drive transistor MD is enhanced so that the threshold voltage Vth becomes to equal to the second threshold voltage Vth2, where the first threshold voltage Vth1 and the second threshold voltage Vth2 may be expressed by the following formulas:

$$Vth1 = \phi_{MS} + 2\phi_F + \frac{Q_{dep}}{c_{ox}},$$

$$Vth2 = Vth1 + \gamma\left(\sqrt{|2\phi_F + V_{sb}|} - \sqrt{2\phi_F}\right).$$

$$\gamma = \frac{\sqrt{2q\varepsilon_{si}N_{sub}}}{C_{ox}},\ \phi_F = \left(\frac{kT}{q}\right)\ln\left(\frac{N_{sub}}{n_i}\right),\ Q_{dep} = \sqrt{4q\varepsilon_{si}|\phi_F|N_{sub}},$$

$\varepsilon_{si}$ denotes a permittivity of silicon, $N_{sub}$ denotes a doping concentration of a substrate, q denotes electron charges, $Q_{dep}$ denotes charges in a depletion region, $C_{ox}$ denotes a capacitance of a gate oxide layer per unit area, $\gamma$ denotes a coefficient of the substrate effect, $\phi_F$ denotes a flat-band barrier, k denotes a Boltzmann constant, T denotes an absolute temperature, $n_i$ denotes an intrinsic doping concentration, and $V_{sb}$ denotes a source-substrate voltage.

The MOS transistor is turned on under a condition that a gate-source voltage Vgs is higher than the threshold voltage Vth. As can be seen from the above formula, the threshold voltage Vth of the MOS transistor is related to not only the manufacturing process but also the electrical setting. The greater the substrate effect of the drive transistor MD (the higher $V_{sb}$), the higher the second threshold voltage Vth2 and the higher the gate-source voltage for turning on the MOS transistor.

At the same time, the gate potential control circuit 20 controls a potential of the gate terminal N1 to be decreased, and the gate-source voltage Vgs of the drive transistor MD is lower than the second threshold voltage Vth2 so that the drive transistor MD is turned off. In the first time period t1, the voltage of the gate terminal N1 of the drive transistor MD is decreased by ΔV1.

In the second time period t2, the voltage VP transmitted on the first power line L1 is increased from the second voltage V2 to the first voltage V1, and the gate potential control circuit 20 controls the potential of the gate terminal N1 to be increased. Where ΔV1 by which the voltage of the gate terminal N1 of the drive transistor MD is decreased in the first time period t1 is higher than ΔV2 by which the voltage of the gate terminal N1 is increased in the second time period t2. Thus, the gate terminal N1 of the drive transistor MD is initialized. At the same time, the threshold voltage Vth of the drive transistor MD is changed from the second threshold voltage Vth2 to the first threshold voltage Vth1 such that the drive transistor MD is turned on when the second time period t2 ends.

According to the technical solutions provided by the embodiments of the present disclosure, in the first time period of the initialization stage, a potential difference between the source terminal and the body terminal of the drive transistor is controlled such that the threshold voltage of the drive transistor is changed from the first threshold voltage to the second threshold voltage, so as to turn off the drive transistor. In the second time period, the potential of the source terminal of the drive transistor is controlled to be restored to an initial potential such that the source terminal and the body terminal have the same potential, and the threshold voltage of the drive transistor is restored to the first threshold voltage, so as to turn on the drive transistor. In other words, the potentials of the source terminal and the body terminal of the drive transistor are controlled and the threshold voltage hysteresis is generated through the substrate effect of the drive transistor so that the threshold voltage of the drive transistor is changed from the first threshold voltage to the second threshold voltage and then restored to the first threshold voltage. During the threshold voltage hysteresis, the potential of the gate terminal of the drive transistor is controlled to be decreased, so as to initialize the potential of the gate terminal of the drive transistor. In the initialization process, the drive transistor is in an off state, and no current flows through the drive transistor. Therefore, the power consumption of the pixel circuit can be reduced, thereby reducing the power consumption of a display panel. Additionally, the pixel circuit provided by the embodiments of the present disclosure does not need to be provided with an initialization transistor, reducing the number of transistors and facilitating the improvement of PPI.

The preceding pixel circuit is not limited to a specific pixel circuit, and any pixel circuit that initializes the gate terminal of the drive transistor through the threshold voltage hysteresis is within the scope of the present disclosure. A specific structure of the pixel circuit is described below. However, the inventive concept of the present disclosure is not limited to the following specific structure of the pixel circuit.

Optionally, the gate potential control circuit includes a first capacitor and a connection transistor, where a second terminal of the first capacitor and a first electrode of the connection transistor are connected to the gate terminal of the drive transistor, and a second electrode of the connection transistor is connected to the drain terminal of the drive transistor; and in the second time period, the gate potential control circuit controls the potential of the gate terminal of the drive transistor to be the same as the potential of the drain terminal of the drive transistor.

Figure 4:
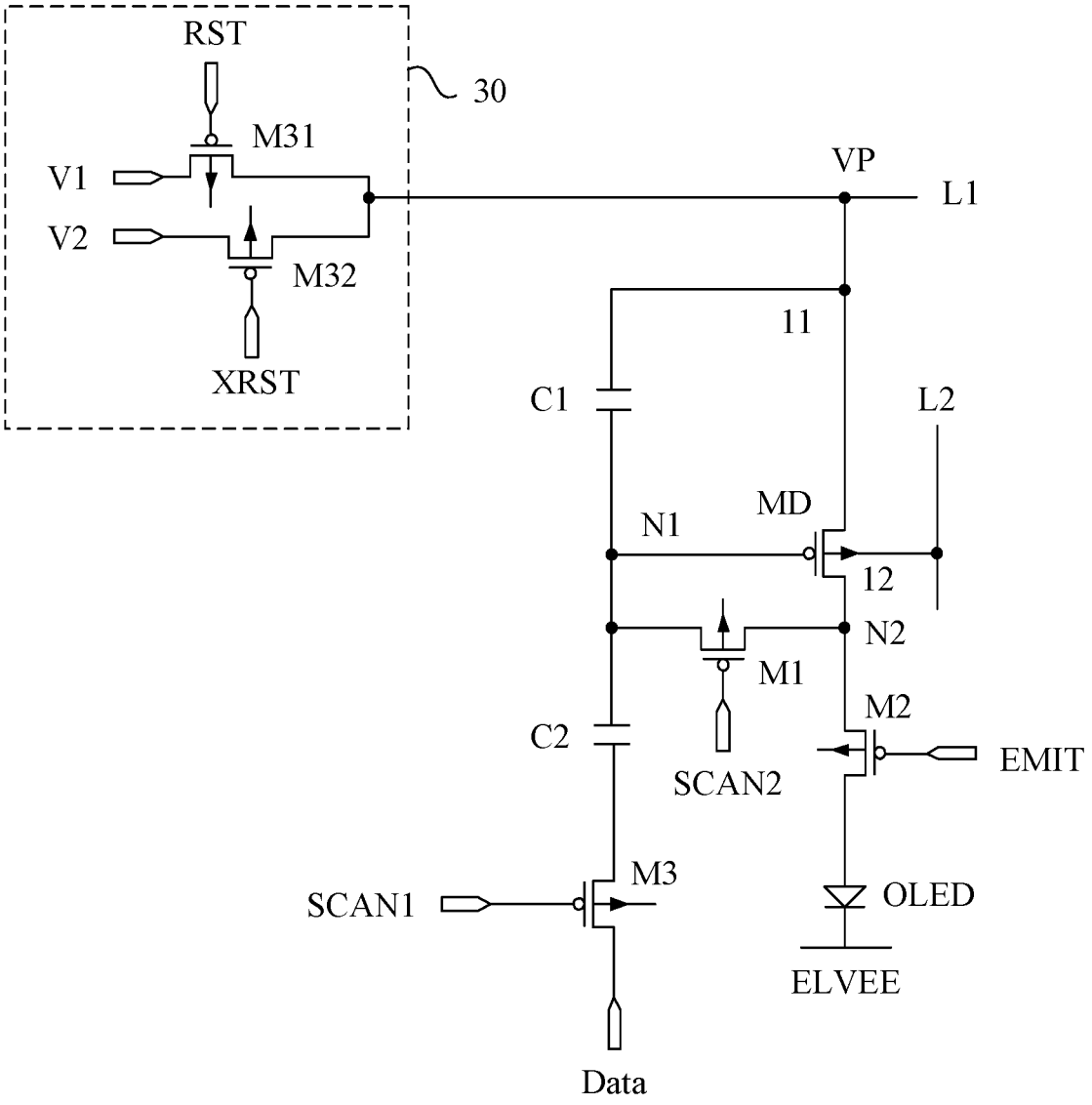
FIG. 4 is a structure diagram of another pixel circuit according to an embodiment of the present disclosure.

Specifically, referring to FIG. 4 which is a structure diagram of another pixel circuit according to an embodiment of the present disclosure, the pixel circuit includes a drive transistor MD, a connection transistor M1, a light emission control transistor M2, a data writing transistor M3, a first capacitor C1, a second capacitor C2, and a light-emitting element OLED. In the structure shown in FIG. 4, a gate potential control circuit includes the first capacitor C1 and the connection transistor M1. The pixel circuit further includes the second capacitor C2 used as a voltage division circuit, the light emission control transistor M2 connected between a drain terminal N2 of the drive transistor MD and the organic light-emitting element OLED, and the data writing transistor M3 configured to write a data voltage. The connection transistor M1 is controlled by a second scan signal SCAN2, the light emission control transistor M2 is controlled by a light emission control signal EMIT, and the data writing transistor M3 is controlled by a first scan signal SCAN1.

Specifically, the drive transistor MD includes a source terminal 11, a drain terminal N2, a gate terminal N1, and a body terminal 12, where the source terminal 11 is connected to a first power line L1, the drain terminal N2 is connected to a second electrode of the connection transistor M1 and a first electrode of the light emission control transistor M2, the gate terminal N1 is connected to a second terminal of the first capacitor C1, a first electrode of the connection transistor M1, and a first terminal of the second capacitor C2, and the body terminal 12 is connected to a second power line L2. A first terminal of the first capacitor C1 is connected to the first power line L1, a second terminal of the second capacitor C2 is connected to a first electrode of the data writing transistor M3, and a second electrode of the data writing transistor M3 is connected to a data line Data. A second electrode of the light emission control transistor M2 is connected to an anode of the light-emitting element OLED.

Optionally, as shown in FIG. 4, the pixel circuit further includes a voltage gating circuit 30 configured to gate a first voltage V1 or a second voltage V2 transmit to the first power line L1. The voltage gating circuit 30 includes a first switch transistor M31 and a second switch transistor M32; where the first switch transistor M31 includes a first electrode for receiving the first voltage V1, a second electrode connected to the first power line L1, and a control terminal connected to a first switch control signal line RST; and the second switch transistor M32 includes a first electrode for receiving the second voltage V2, a second electrode connected to the first power line L1, and a control terminal connected to a second switch control signal line XRST.

Specifically, for ease of description, a signal line and a signal transmitted on the signal line are represented by the same reference numeral. A first switch control signal RST transmitted by the first switch control signal line is reverse to a second switch control signal XRST transmitted by the second switch control signal line. The control signals transmitted by the first switch control signal line and the second switch control signal line satisfy the following conditions: in a first time period t1 of an initialization stage, the first switch transistor M31 is turned off under the control of the first switch control signal RST transmitted by the first switch control signal line, and the second switch transistor M32 is turned on under the control of the second switch control signal XRST transmitted by the second switch control signal line so that the second voltage V2 is transmitted by the first power line L1, so as to increase a threshold voltage Vth of the drive transistor MD. In a second time period t2, the first switch transistor M31 is turned on under the control of the first switch control signal RST transmitted by the first switch control signal line, and the second switch transistor M32 is turned off under the control of the second switch control signal XRST transmitted by the second switch control signal line so that the first voltage V1 is transmitted by the first power line L1, so as to decrease the threshold voltage Vth of the drive transistor MD.

Figure 5:
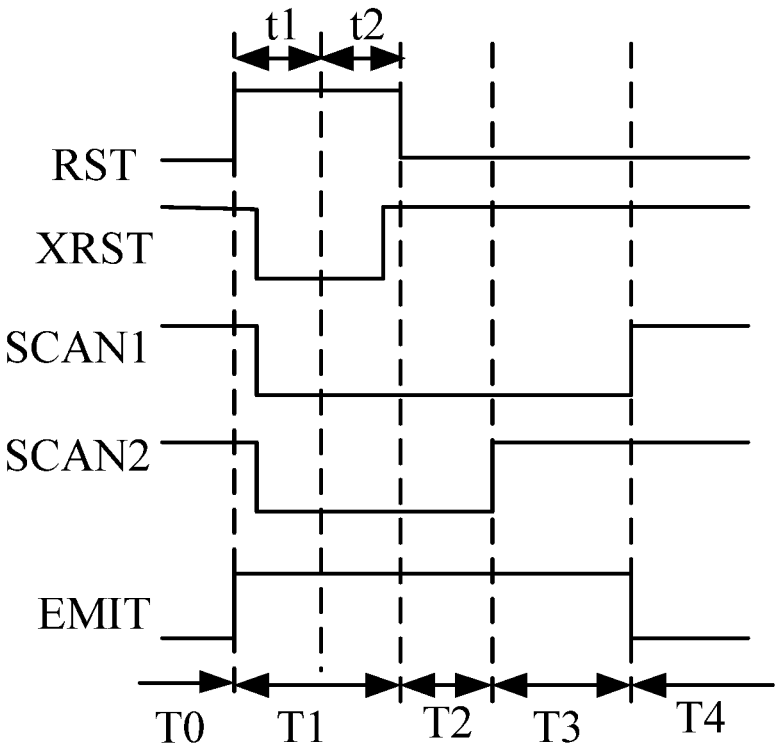
FIG. 5 is a waveform diagram showing control timing sequence of a pixel circuit according to an embodiment of the present disclosure.

FIG. 5 is a waveform diagram showing control timing sequence of a pixel circuit according to an embodiment of the present disclosure, which is applicable to the pixel circuit shown in FIG. 4. As shown in FIGS. 4 and 5, the specific working principle of the pixel circuit is described by using an example in which all transistors are p-type MOS (PMOS) transistors. The working process of the pixel circuit provided by the embodiments of the present disclosure includes at least an initialization stage T1, a threshold detection stage T2, a data writing stage T3, and a light emission stage T4.

At a light emission stage T0 of a previous frame, the first switch control signal RST is at a logic low level, the second switch control signal XRST is at a logic high level, a voltage VP transmitted on the first power line L1 is equal to the first voltage V1, the drive transistor MD has no substrate effect, the threshold voltage Vth is equal to a first threshold voltage Vth1, the drive transistor MD is in an on state for light emission and display, and the gate terminal N1 of the drive transistor MD receives a display data voltage for the previous frame. When the light emission stage T0 of the previous frame ends, the pixel circuit enters the initialization stage T1 of a current frame, which includes the first time period t1 and the second time period t2.

Optionally, in the first time period t1, there is a delay between when the first switch control signal RST changes and when the second switch control signal XRST changes, that is, the second switch control signal XRST changes from the logic high level to the logic low level after the first switch control signal RST changes from the logic low level to the logic high level, so as to ensure the stability of a signal provided by the voltage gating circuit 30. In the first time period t1, the second scan signal SCAN2 is at the logic low level and controls the connection transistor M1 to be turned on, the first scan signal SCAN1 is at the logic low level and controls the data writing transistor M3 to be turned on, a fixed signal Vofs is input to the second electrode of the data writing transistor M3, and the light emission control signal EMIT is at the logic high level and controls the light emission control transistor M2 to be turned off. That is, the light emission control transistor M2 operates in a cutoff region at this time.

In the first time period t1, the voltage VP transmitted on the first power line L1 is equal to the second voltage V2, the threshold voltage Vth of the drive transistor MD is increased due to the substrate effect from the first threshold voltage Vthl to the second threshold voltage Vth2, and the drive transistor MD is turned off and has a very small leakage current so that the light-emitting element OLED does not emit light, reducing power consumption. Since the first terminal of the first capacitor C1 is connected to the first power line L1, when the voltage VP transmitted on the first power line L1 is changed from the first voltage V1 to the second voltage V2, a voltage of the first terminal of the first capacitor C1 is decreased by V1−V2. Since the voltage is divided by the second capacitor C2 coupled to the first capacitor C1, a voltage of the gate terminal N1 of the drive transistor MD is decreased by ΔV11 which is equal to a divided voltage of the second capacitor C2 and the first capacitor C1.

$$\Delta V11 = (V1 - V2)\frac{c1}{c1 + c2}.$$

Where c1 denotes a capacitance value of the first capacitor C1 and c2 denotes a capacitance value of the second capacitor C2. At the same time, the gate terminal N1 is connected to the drain terminal N2 through the connection transistor M1. Since a potential of the drain terminal N2 is lower than a potential of the gate terminal N1, the voltage of the gate terminal N1 is further decreased by the drain terminal N2. The voltage of the gate terminal N1 is further decreased by ΔV12. In the first time period t1, the voltage of the gate terminal N1 is decreased by ΔV1=ΔV11+ΔV12.

In the second time period t2, the second switch control signal XRST is changed to the logic high level while the light emission control signal EIMT is still at the logic high level, the first scan signal SCAN1 and the second scan signal SCAN2 are still at the logic low level, and the first switch control signal RST is still at the logic high level, so as to ensure the stability of a potential on the first power line L1. When the first switch control signal RST is changed from the logic high level to the logic low level, the voltage VP transmitted on the first power line L1 is changed from the second voltage V2 to the first voltage V1, the voltage of the first terminal of the first capacitor C1 is changed from the second voltage V2 to the first voltage V1, and the potential of the gate terminal N1 is then increased. The voltage of the gate terminal N1 is increased by ΔV2, where $$\Delta V2 = (V1 - V2)\frac{c1}{c1 + c2} = \Delta V11.$$

That is, ΔV11 by which the voltage of the gate terminal N1 is decreased due to a decrease from the first voltage V1 to the second voltage V2 in the first time period t1 is equal to ΔV2 by which the voltage of the gate terminal N1 is increased due to an increase from the second voltage V2 to the first voltage V1 in the second time period t2. However, since the potential of the gate terminal N1 has been further decreased by the drain terminal N2, ΔV2 by which the voltage of the gate terminal N1 is increased in the second time period t2 is smaller than ΔV1 by which the potential of the gate terminal N1 is decreased in the first time period t1, and the voltage of the gate terminal N1 in the second time period t2 is lower than the potential of the gate terminal N1 in the first time period t1 so that the potential of the gate terminal N1 is decreased. Meanwhile, when the second time period t2 ends, the threshold voltage Vth of the drive transistor MD is decreased from the second threshold voltage Vth2 to the first threshold voltage Vth1, and the drive transistor MD is turned on. At this time, the potential of the gate terminal N1 is initialized through the threshold voltage hysteresis of the drive transistor MD due to the substrate effect, and in the initialization process, the drive transistor MD is in an off state, and the light-emitting element OLED does not emit light, which is conducive to reducing the power consumption.

In this embodiment, at the initialization stage T1, a pulse of the second switch control signal XRST is located within an interval where a pulse of the first switch control signal RST is located so that the first switch control signal RST and the second switch control signal XRST will not jump at the same time. When the level of the first switch control signal RST is changed, the level of the second switch control signal XRST is to be changed, which can ensure the stability of the voltage VP transmitted on the first power line L1.

Optionally, in the embodiments of the present disclosure, the first voltage V1 is a power voltage ELVDD for light emission and display of the pixel circuit.

After the initialization stage T1 is completed, the pixel circuit enters the threshold detection stage T2. At the threshold detection stage T2, the first switch control signal RST is at the logic low level, the second switch control signal XRST is at the logic high level, the first scan signal SCAN1 outputted from a first scan line is at the logic low level, the second scan signal SCAN2 outputted from a second scan line is at the logic low level, and the light emission control signal EMIT outputted from a light emission control signal line is at the logic high level so that the connection transistor M1 and the data writing transistor M3 are turned on, the light emission control transistor M2 is turned off, and the drive transistor MD is a diode connection structure.

The gate terminal N1 of the drive transistor MD is charged by the first voltage V1, that is, the power voltage ELVDD for light emission and display, through the drive transistor MD and the connection transistor M1 so that the potential of the gate terminal N1 is increased until the potential of the gate terminal N1 is ELVDD−|Vth|. Thus, the drive transistor MD is turned off, and the voltage of the gate terminal N1 is stored in the first capacitor C1 and the second capacitor C2. The stored voltage includes threshold information of the drive transistor MD so that the threshold voltage Vth of the drive transistor MD is detected.

At the data writing stage T3, the first switch control signal RST is at the logic low level, the second switch control signal XRST is at the logic high level, the first scan signal SCAN1 outputted from the first scan line is at the logic low level, the second scan signal SCAN2 outputted from the second scan line is at the logic high level, and the light emission control signal EMIT outputted from the light emission control signal line is at the logic high level so that the first switch transistor M31 and the data writing transistor M3 are turned on, and the second switch transistor M32, the connection transistor M1, and the light emission control transistor M2 are turned off. At this time, the data line Data is configured to transmit the data voltage. Under the voltage division effect of the first capacitor C1 and the second capacitor C2, the potential of the gate terminal N1 of the drive transistor MD becomes to be equal to $$V_{N1} = ELVDD - |V_{th}| - (V_{data} - V_{ofs}) \times \left(\frac{c1}{c1 + c2}\right).$$

$V_{data}$ denotes the data voltage, Vofs denotes a fixed voltage transmitted by the data line Data, c1 denotes the capacitance value of the first capacitor C1, and c2 denotes the capacitance value of the second capacitor C2.

In this embodiment, after the data voltage $V_{data}$ corresponding to a to-be-displayed grayscale is divided by the first capacitor C1 and the second capacitor C2, a lower voltage is written to the gate terminal N1 so that the data voltage $V_{data}$ is written within a wider range and gamma adjustment is performed within a wider range.

At the light emission stage T4, the first switch control signal RST is at the logic low level, the second switch control signal XRST is at the logic high level, the first scan signal SCAN1 outputted from the first scan line is at the logic high level, the second scan signal SCAN2 outputted from the second scan line is at the logic high level, and the light emission control signal EMIT outputted from the light emission control signal line is at the logic low level so that the first switch transistor M31 and the light emission control transistor M2 are turned on, and the second switch transistor M32, the connection transistor M1, and the data writing transistor M3 are turned off. The drive transistor MD generates a light emission current $I_{OLED}$ to drive the light-emitting element OLED to emit light. The light emission current $I_{OLED}$ may be expressed as follows:

$$I_{OLED} = \frac{1}{2}\mu C_{OX}\frac{W_P}{L_P}$$

$$\left(ELVDD - ELVDD + |V_{th}| - |V_{th}| + (V_{data} - V_{ofs}) \times \left(\frac{c1}{c1 + c2}\right)\right)^2 =$$

-continued $$\frac{1}{2}\mu C_{OX}\frac{W_P}{L_P}\left((V_{data}-V_{ofs})\times\left(\frac{c1}{c1+c2}\right)\right)^2.$$

μ denotes a carrier mobility of the drive transistor MD, $C_{ox}$ denotes a capacitance of an oxide layer of the drive transistor MD per unit area, and $W_P/L_P$ denotes a width-to-length ratio of the drive transistor MD.

As can be seen from the above formula, the light emission current $I_{OLED}$ of the pixel circuit is independent of the threshold voltage Vth of the drive transistor MD and the first voltage V1 transmitted on the power line so that an effect of IR-Drop of the threshold voltage Vth and the first voltage V1 is compensated for, and all pixels are driven by the same current to emit light, ensuring the uniformity of the current, improving display uniformity, and facilitating the improvement of the display effect.

Under the control timing in FIG. 5, the light emission control transistor M2 is controlled to operate in the cutoff region at the initialization stage T1. When the light emission control transistor M2 operates in the cutoff region at the initialization stage T1, a voltage of the source terminal of the drive transistor MD is lower than the voltage of the gate terminal. In the first time period t1 of the initialization stage, the voltage of the gate terminal N1 of the drive transistor MD is decreased and the threshold voltage is increased. When the voltage of the gate terminal N1 is decreased until a gate-source voltage Vgs of the drive transistor MD is lower than the threshold voltage of the drive transistor MD, the gate terminal N1 is initialized in theory. Since the first voltage V1 is the power voltage ELVDD for light emission and display of the pixel circuit, the voltage VP on the first power line L1 needs to be restored to the first voltage V1, so as to ensure the normal light emission and display of the pixel circuit. Since the potential of the source terminal 11 of the drive transistor is increased as the voltage VP on the first power line L1 is increased, the potential of the gate terminal N1 is decreased by the potential of the drain terminal N2 at the initialization stage such that the potential of the gate terminal N1 is equal to the potential of the drain terminal N2, which may ensure the stability of the initialization stage. When the potential of the gate terminal N1 is equal to the potential of the drain terminal N2, that is, the voltage of the gate terminal N1 and the voltage of the drain terminal N2 are equal to a divided voltage of the two points, ΔV12 by which the voltage of the gate terminal N1 is decreased is equal to the divided voltage after the voltage of the gate terminal N1 is decreased by ΔV11. In the pixel circuit, the potential of the drain terminal N2 is generally lower than the potential of the gate terminal N1. In some cases, however, the potential of the drain terminal N2 may be equal to or slightly higher than the voltage of the gate terminal N1. Thus, the light emission control transistor M2 may be configured to operate in a saturation region or a linear region at the initialization stage, so as to decrease the potential of the drain terminal N2.

Figure 6:
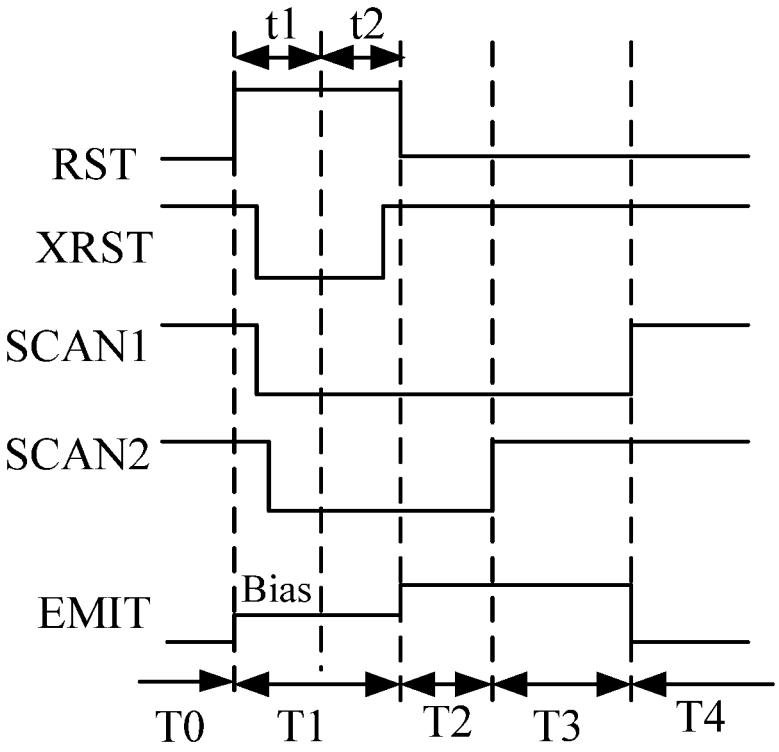
FIG. 6 is a waveform diagram showing control timing sequence of another pixel circuit according to an embodiment of the present disclosure.

Optionally, the light emission control transistor M2 is controlled to operate in the saturation region at the initialization stage. FIG. 6 is a waveform diagram showing control timing sequence of another pixel circuit according to an embodiment of the present disclosure, which is also applicable to the pixel circuit shown in FIG. 4. As shown in FIGS. 4 and 6, the working process of the pixel circuit provided by the embodiments of the present disclosure includes at least the initialization stage T1, the threshold detection stage T2, the data writing stage T3, and the light emission stage T4. In this embodiment, at the initialization stage T1, the light emission control transistor M2 is controlled to operate in the saturation region so that the potential of the drain terminal N2 is decreased and the potential of the gate terminal N1 is further decreased.

Optionally, in this embodiment, at the initialization stage T1, the connection transistor M1 delays being turned on so that the potential of the gate terminal N1 is further decreased and a variation of the voltage of the gate terminal N1 is stabilized.

Specifically, in the first time period t1 of the initialization stage T1, there is a delay between when the first switch control signal RST jumps and when the second switch control signal XRST jumps. That is to say, after the first switch control signal RST jumps from the logic low level to the logic high level, that is, after a signal of the second voltage V2 becomes relatively stable, the second switch control signal XRST jumps from the logic high level to the logic low level, and the first voltage V1 stops being transmitted, ensuring the stability of a change in voltage. When the voltage VP transmitted on the first power line L1 is equal to the second voltage V2, the threshold voltage Vth of the drive transistor MD is increased due to the substrate effect from the first threshold voltage Vth1 to the second threshold voltage Vth2, and the drive transistor MD is turned off. At the same time, the light emission control signal EMIT provides a bias voltage Bias to control the light emission control transistor M2 to operate in the saturation region, a weak current flows through the light emission control transistor M2, and the drain terminal N2 is discharged through the light emission control transistor M2 to the light-emitting element OLED so that the potential of the drain terminal N2 is decreased.

When the voltage VP transmitted on the first power line L1 is equal to the second voltage V2, the potential of the second terminal of the first capacitor C1, that is, the gate terminal N1, is changed accordingly. At this time, the connection transistor M1 and the light emission control transistor M3 are off, and the potential of the gate terminal N1 is changed with the voltage VP. The voltage of the gate terminal N1 is decreased by ΔV11, where $$\Delta V11=(V1-V2)\frac{c1}{c1+c2}.$$

Then, the second scan signal SCAN2 delays being at the logic low level, the connection transistor M1 is turned on, the gate terminal N1 is connected to the drain terminal N2 such that the gate terminal N1 and the drain terminal N2 have the same potential, that is, the voltage of the gate terminal N1 and the voltage of the drain terminal N2 are equal to the divided voltage of the two points, and ΔV12 by which the voltage of the gate terminal N1 is decreased is equal to the divided voltage after the voltage of the gate terminal N1 is decreased by ΔV11 so that the potential of the gate terminal N1 is decreased by the drain terminal N2. In contrast to the control timing shown in FIG. 5, the light emission control transistor M2 operates in the saturation region in the control timing shown in FIG. 6 so that the potential of the drain terminal N2 of the drive transistor MD is further decreased. Subsequently, the potential of the gate terminal N1 may be further decreased by the potential of the drain terminal N2.

Optionally, the connection transistor M1 may not be configured to delay being turned on. In this case, the voltage of the gate terminal N1 is decreased by ΔV11 and ΔV12 at the same time, achieving the same effect. However, a more stable effect can be achieved when the connection transistor M1 delays being turned on.

In the second time period t2 of the initialization stage T1, the second switch control signal XRST jumps to the logic high level, the voltage VP transmitted on the first power line L1 is changed from the second voltage V2 to the first voltage V1, and ΔV2 by which the voltage of the gate terminal N1 is increased is equal to AV11 and smaller than (ΔV11+ΔV12) by which the voltage of the gate terminal N1 is decreased in the first time period t1 so that the voltage of the gate terminal N1 is decreased and initialized. When the initialization stage T1 ends, the threshold voltage Vth of the drive transistor MD is decreased from the second threshold voltage Vth2 to the first threshold voltage Vth1, and the drive transistor MD is turned on.

For the working process at the threshold detection stage T2, the data writing stage T3, and the light emission stage T4, reference may be made to the preceding related description. The details are not repeated here.

Figure 7:
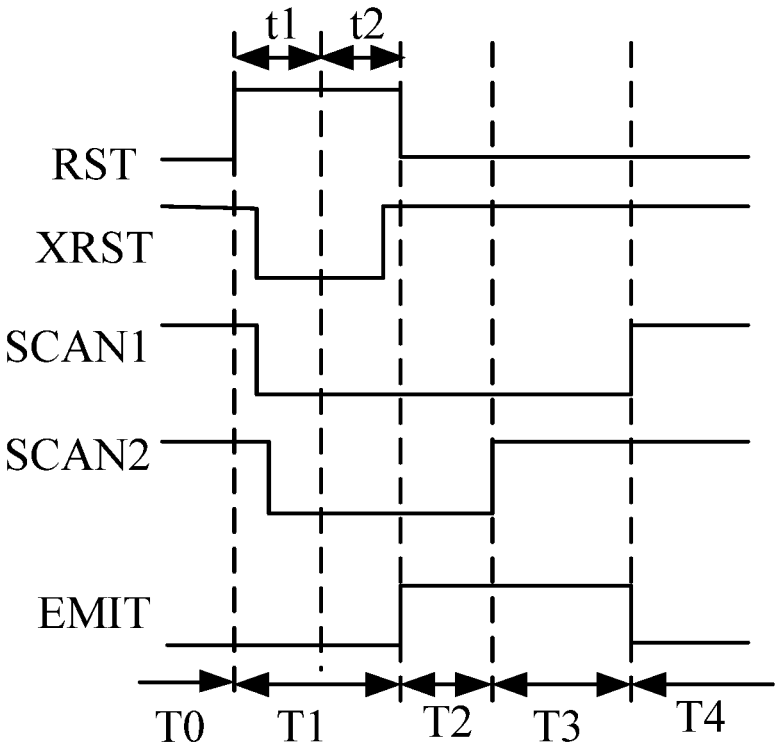
FIG. 7 is a waveform diagram showing control timing sequence of another pixel circuit according to an embodiment of the present disclosure.

Optionally, FIG. 7 is a waveform diagram showing control timing sequence of another pixel circuit according to an embodiment of the present disclosure, which is also applicable to the pixel circuit shown in FIG. 4. As shown in FIGS. 4 and 7, the working process of the pixel circuit provided by the embodiments of the present disclosure includes at least the initialization stage T1, the threshold detection stage T2, the data writing stage T3, and the light emission stage T4. For the same content in the drive timing in FIG. 7 and the drive timing in FIG. 5 or FIG. 6, reference may be made to the description of FIG. 5 or FIG. 6. The details are not repeated here. The drive timing in FIG. 7 is different from the drive timing in FIG. 5 or FIG. 6 in that optionally, in this embodiment, the light emission control transistor M2 is controlled to operate in a linear region at the initialization stage T1. Thus, the potential of the drain terminal N2 is decreased by the light emission control transistor M2, and the potential of the gate terminal N1 is further decreased.

At the initialization stage T1, the first switch control signal RST is at the logic high level, the second switch control signal XRST is at the logic low level. When the voltage VP transmitted on the first power line L1 is changed from the first voltage V1 to the second voltage V2, the threshold voltage Vth of the drive transistor MD is increased due to the substrate effect from the first threshold voltage Vth1 to the second threshold voltage Vth2, and the drive transistor MD is turned off. The voltage of the second terminal of the first capacitor C1, that is, the gate terminal N1, is decreased by ΔV11, where $$\Delta V11 = (V1 - V2)\frac{c1}{c1 + c2}.$$

At the same time, the light emission control signal EMIT is at the logic low level so that the light emission control transistor M2 is turned on, and the potential of the drain terminal N2 is decreased to a potential which differs from a cathode potential ELVEE of the light-emitting element OLED by a threshold voltage of the light-emitting element OLED. The first scan signal SCAN1 is at the logic low level, the second scan signal SCAN2 is at the logic low level, and the gate terminal N1 is connected to the drain terminal N2 such that the gate terminal N1 and the drain terminal N2 have the same potential, that is, the voltage of the gate terminal N1 and the voltage of the drain terminal N2 are equal to the divided voltage of the two points, and ΔV12 by which the voltage of the gate terminal N1 is decreased is equal to the divided voltage after the voltage of the gate terminal N1 is decreased by ΔV11 so that the potential of the gate terminal N1 is decreased by the drain terminal N2. In contrast to the control timing shown in FIG. 5, the light emission control transistor M2 is controlled to operate in the linear region in the control timing shown in FIG. 7 so that the potential of the drain terminal N2 of the drive transistor MD is further decreased. Subsequently, the potential of the gate terminal N1 may be further decreased by the potential of the drain terminal N2.

In the second time period t2 of the initialization stage T1, the second switch control signal XRST jumps to the logic high level, the voltage VP transmitted on the first power line L1 is changed from the second voltage V2 to the first voltage V1, and ΔV2 by which the voltage of the gate terminal N1 is increased is equal to ΔV11 and smaller than (ΔV11+ΔV12) by which the voltage of the gate terminal N1 is decreased in the first time period so that the voltage of the gate terminal N1 is decreased and initialized. When the initialization stage T1 ends, the threshold voltage Vth of the drive transistor MD is decreased from the second threshold voltage Vth2 to the first threshold voltage Vth1, and the drive transistor MD is turned on.

For the working process at the threshold detection stage T2, the data writing stage T3, and the light emission stage T4, reference may be made to the preceding related description. The details are not repeated here.

Figure 8:
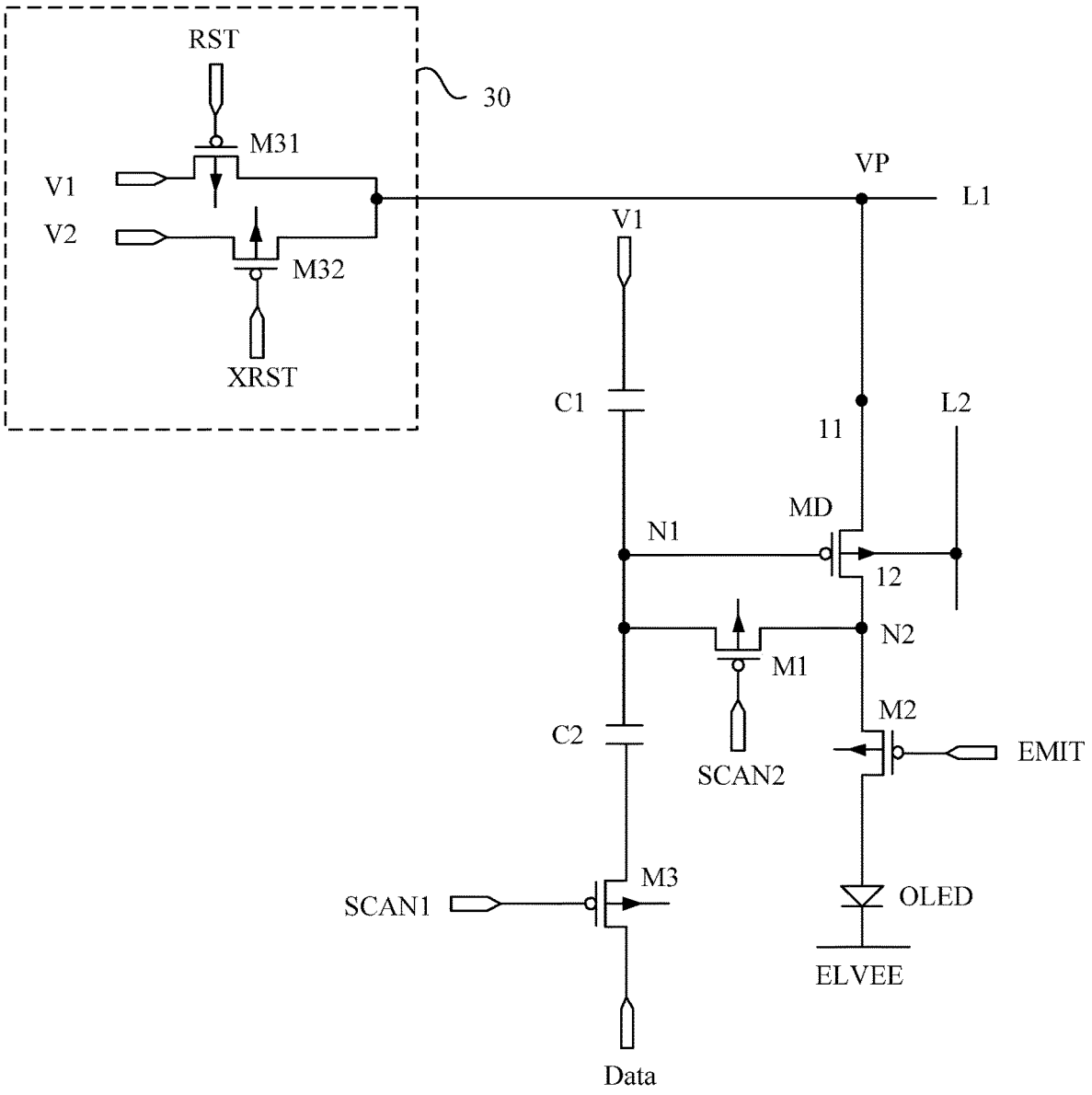
FIG. 8 is a structure diagram of another pixel circuit according to an embodiment of the present disclosure.

Optionally, FIG. 8 is a structure diagram of another pixel circuit according to an embodiment of the present disclosure, which is also applicable to the control timings shown in FIGS. 5, 6, and 7. The pixel circuit is different from the pixel circuit shown in FIG. 4 in that the first terminal of the first capacitor C1 is connected in a different manner. In the pixel circuit shown in FIG. 8, the first terminal of the first capacitor C1 is connected to the fixed first voltage V1. In the first time period t1 of the initialization stage T1, the potential of the first terminal of the first capacitor C1 remains unchanged so that the potential of the gate terminal N1 of the drive transistor MD also remains unchanged, that is, ΔV11 is 0. However, in the second time period t2 of the initialization stage T1, the variation of the potential of the gate terminal N1 is not affected by an increase from the second voltage V2 to the first voltage V1. The potential of the gate terminal N1 of the drive transistor MD is reduced only by the drain terminal N2 of the drive transistor MD. The working process is the same as that of the pixel circuit shown in FIG. 5. The details are not repeated here.

Figure 9:
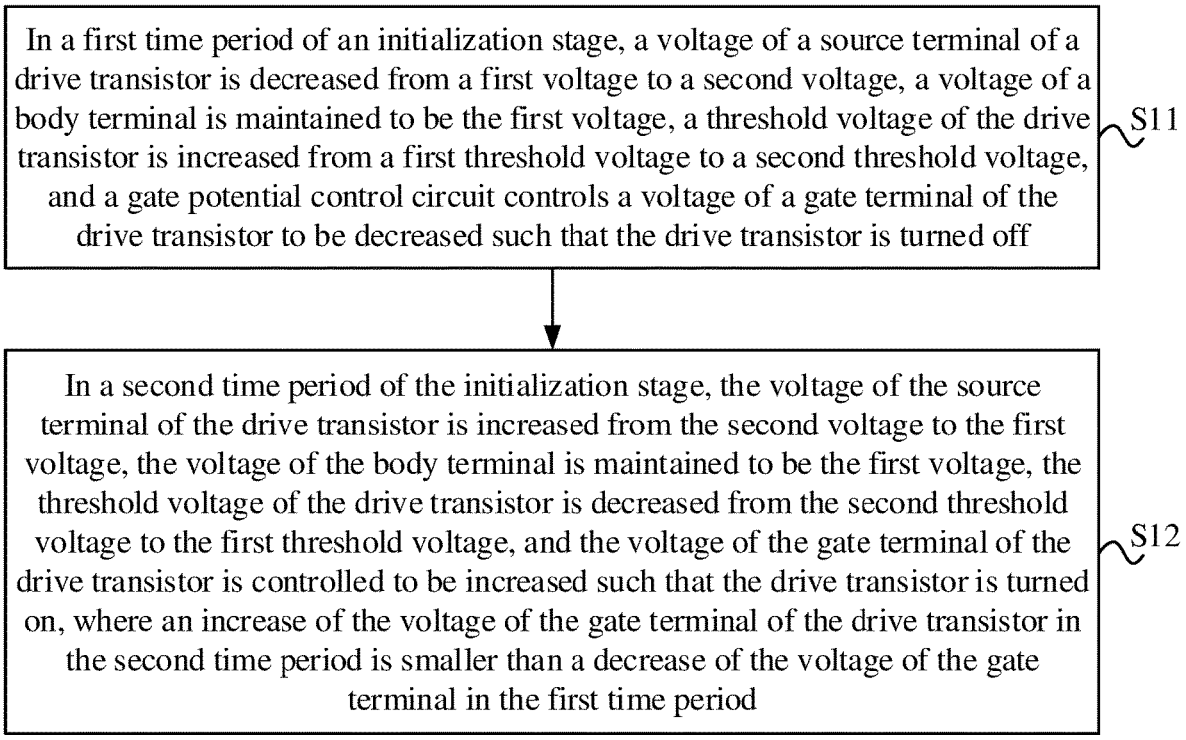
FIG. 9 is a flowchart of a method for driving a pixel circuit according to an embodiment of the present disclosure.

The embodiments of the present disclosure further provide a method for driving a pixel circuit. Referring to FIG. 2, the pixel circuit includes a drive transistor MD, where a source terminal 11 of the drive transistor MD is connected to a first power line L1, and a gate terminal N1 of the drive transistor MD is connected to a gate potential control circuit 20. The first power line L1 is configured to provide a first voltage V1 or a second voltage V2, where the first voltage V1 is higher than the second voltage V2. A second power line L2 is configured to provide the fixed first voltage V1. FIG. 9 is a flowchart of a method for driving a pixel circuit according to an embodiment of the present disclosure. As shown in FIG. 9, the method for driving a pixel circuit includes steps described below.

In step S11, in a first time period of an initialization stage, a voltage of the source terminal of the drive transistor is decreased from the first voltage to the second voltage, a voltage of a body terminal is maintained to be the first voltage, a threshold voltage of the drive transistor is increased from a first threshold voltage to a second threshold voltage, and the gate potential control circuit controls a voltage of the gate terminal of the drive transistor to be decreased such that the drive transistor is turned off.

In step S12, in a second time period of the initialization stage, the voltage of the source terminal of the drive transistor is increased from the second voltage to the first voltage, the voltage of the body terminal is maintained to be the first voltage, the threshold voltage of the drive transistor is decreased from the second threshold voltage to the first threshold voltage, and the voltage of the gate terminal of the drive transistor is controlled to be increased such that the drive transistor is turned on, where an increase of the voltage of the gate terminal of the drive transistor in the second time period is smaller than a decrease of the voltage of the gate terminal in the first time period.

In the method for driving a pixel circuit provided by the embodiments of the present disclosure, in the first time period of the initialization stage, a potential difference between the source terminal and the body terminal of the drive transistor is controlled such that the threshold voltage of the drive transistor is changed from the first threshold voltage to the second threshold voltage, so as to turn off the drive transistor. In the second time period, the potential of the source terminal of the drive transistor is controlled to be restored such that the source terminal and the body terminal have the same potential, and the threshold voltage of the drive transistor is restored to the first threshold voltage, so as to turn on the drive transistor. In other words, the potentials of the source terminal and the body terminal of the drive transistor are controlled and a threshold voltage hysteresis is generated through a substrate effect of the drive transistor so that the threshold voltage of the drive transistor is changed from the first threshold voltage to the second threshold voltage and then restored to the first threshold voltage. During the threshold voltage hysteresis, a potential of a control terminal of the drive transistor is changed, so as to initialize the potential of the control terminal of the drive transistor. In the initialization process, the drive transistor is in an off state, and no current flows through the drive transistor. Therefore, the power consumption of the pixel circuit can be reduced, thereby reducing the power consumption of a display panel. Additionally, the pixel circuit provided by the embodiments of the present disclosure does not need to be provided with an initialization transistor, reducing the number of transistors and facilitating the improvement of PPI.

Figure 10:
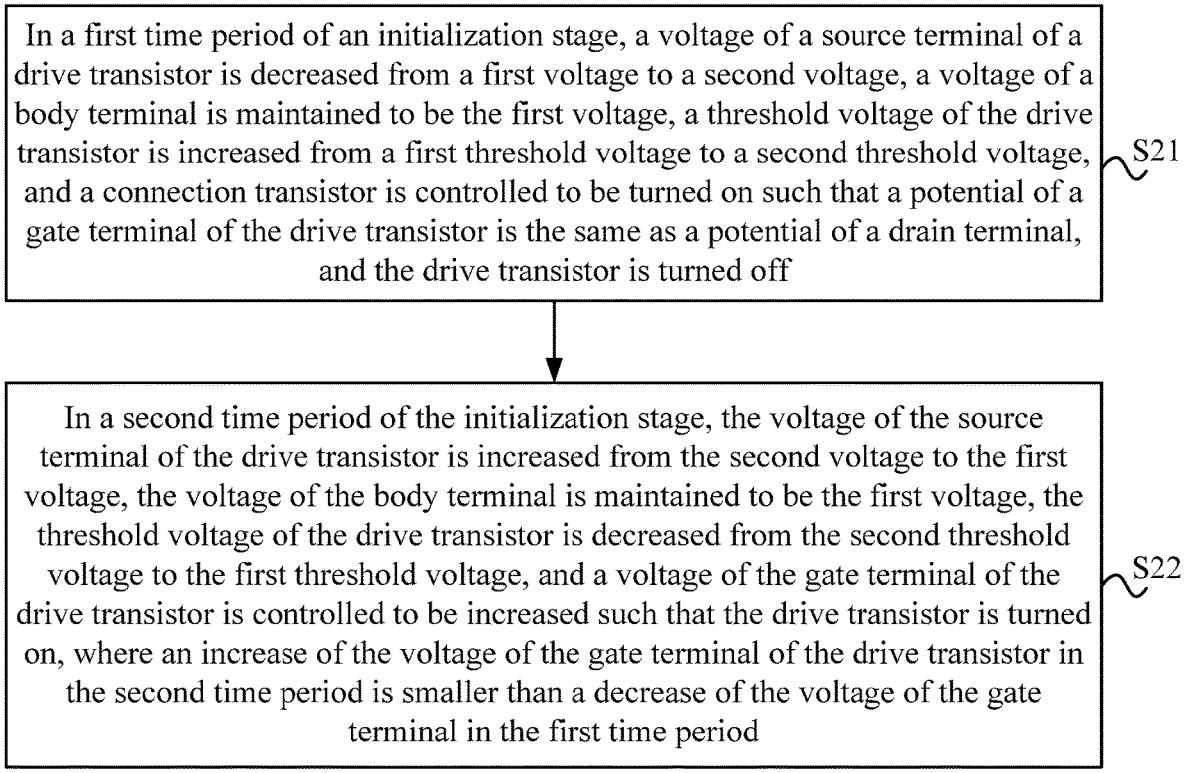
FIG. 10 is a flowchart of another method for driving a pixel circuit according to an embodiment of the present disclosure.

Optionally, FIG. 10 is a flowchart of another method for driving a pixel circuit according to an embodiment of the present disclosure. Referring to FIG. 4, the drive transistor MD in the pixel circuit includes the source terminal 11, a drain terminal N2, the gate terminal N1, and the body terminal 12, where the source terminal 11 is connected to the first power line L1, the drain terminal N2 is connected to a second electrode of a connection transistor M1 and a first electrode of a light emission control transistor M2, the gate terminal N1 is connected to a second terminal of a first capacitor C1, a first electrode of the connection transistor M1, and a first terminal of a second capacitor C2, and the body terminal 12 is connected to the second power line L2. A first terminal of the first capacitor C1 is connected to the first power line L1, a second terminal of the second capacitor C2 is connected to a first electrode of a data writing transistor M3, and a second electrode of the data writing transistor M3 is connected to a data signal input terminal DATA. A second electrode of the light emission control transistor M2 is connected to an anode of a light-emitting element OLED. Referring to FIG. 10, the method specifically includes steps described below.

In step S21, in the first time period of the initialization stage, the voltage of the source terminal of the drive transistor is decreased from the first voltage to the second voltage, the voltage of the body terminal is maintained to be the first voltage, the threshold voltage of the drive transistor is increased from the first threshold voltage to the second threshold voltage, and the connection transistor is controlled to be turned on such that the potential of the gate terminal of the drive transistor is the same as the potential of the drain terminal, and the drive transistor is turned off.

In step S22, in the second time period of the initialization stage, the voltage of the source terminal of the drive transistor is increased from the second voltage to the first voltage, the voltage of the body terminal is maintained to be the first voltage, the threshold voltage of the drive transistor is decreased from the second threshold voltage to the first threshold voltage, and the voltage of the gate terminal of the drive transistor is controlled to be increased such that the drive transistor is turned on, where the increase of the voltage of the gate terminal of the drive transistor in the second time period is smaller than the decrease of the voltage of the gate terminal in the first time period.

Optionally, in the first time period, after the voltage of the source terminal of the drive transistor is decreased from the first voltage to the second voltage, the connection transistor delays being turned on.

Optionally, in the first time period, when the voltage of the source terminal of the drive transistor is decreased from the first voltage to the second voltage, a voltage of the first terminal of the first capacitor is decreased from the first voltage to the second voltage or is maintained to be the first voltage.

Figure 11:
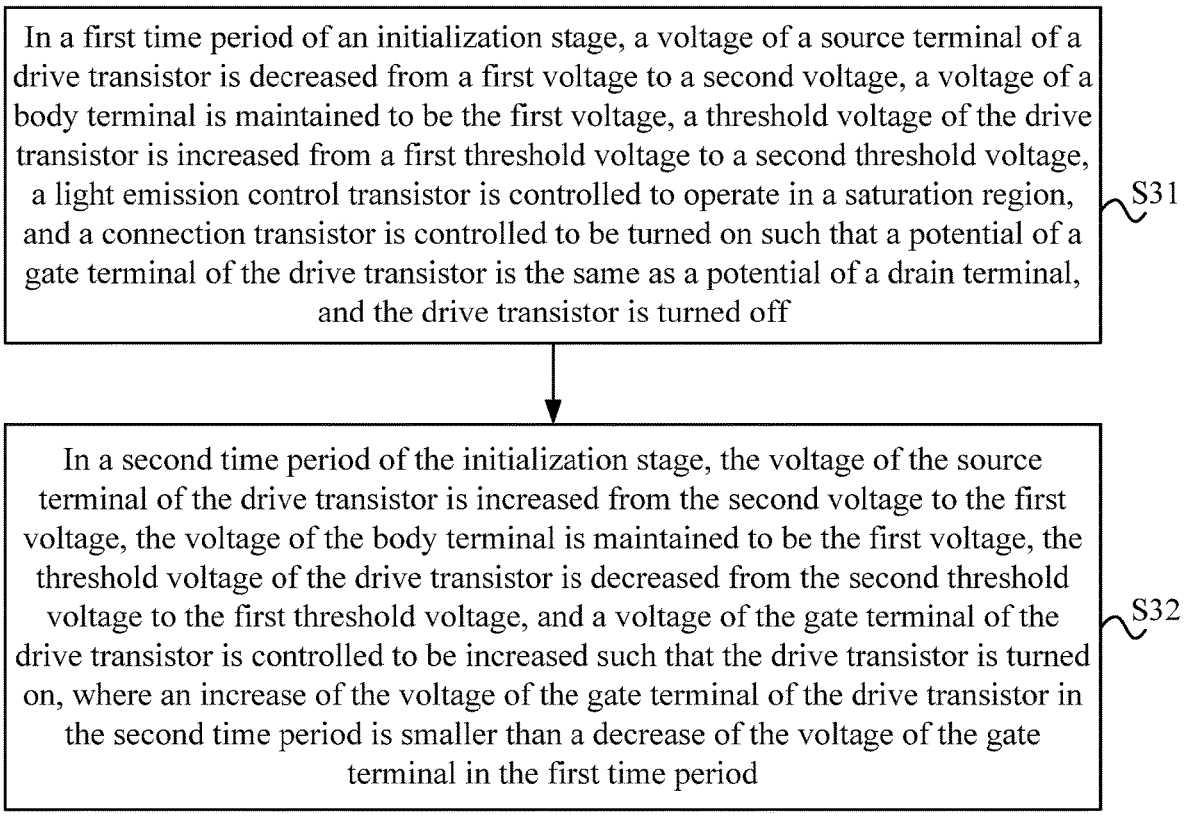
FIG. 11 is a flowchart of another method for driving a pixel circuit according to an embodiment of the present disclosure.

Further, FIG. 11 is a flowchart of another method for driving a pixel circuit according to an embodiment of the present disclosure. Referring to FIGS. 4 and 11, the method specifically includes steps described below.

In step S31, in the first time period of the initialization stage, the voltage of the source terminal of the drive transistor is decreased from the first voltage to the second voltage, the voltage of the body terminal is maintained to be the first voltage, the threshold voltage of the drive transistor is increased from the first threshold voltage to the second threshold voltage, the light emission control transistor is controlled to operate in a saturation region, and the connection transistor is controlled to be turned on such that the potential of the gate terminal of the drive transistor is the same as the potential of the drain terminal, and the drive transistor is turned off.

In step S32, in the second time period of the initialization stage, the voltage of the source terminal of the drive transistor is increased from the second voltage to the first voltage, the voltage of the body terminal is maintained to be the first voltage, the threshold voltage of the drive transistor is decreased from the second threshold voltage to the first threshold voltage, and the voltage of the gate terminal of the drive transistor is controlled to be increased such that the drive transistor is turned on, where the increase of the voltage of the gate terminal of the drive transistor in the second time period is smaller than the decrease of the voltage of the gate terminal in the first time period.

Optionally, in the first time period, after the voltage of the source terminal of the drive transistor is decreased from the first voltage to the second voltage, the connection transistor delays being turned on.

Optionally, in the first time period, when the voltage of the source terminal of the drive transistor is decreased from the first voltage to the second voltage, the voltage of the first terminal of the first capacitor is decreased from the first voltage to the second voltage or is maintained to be the first voltage.

Figure 12:
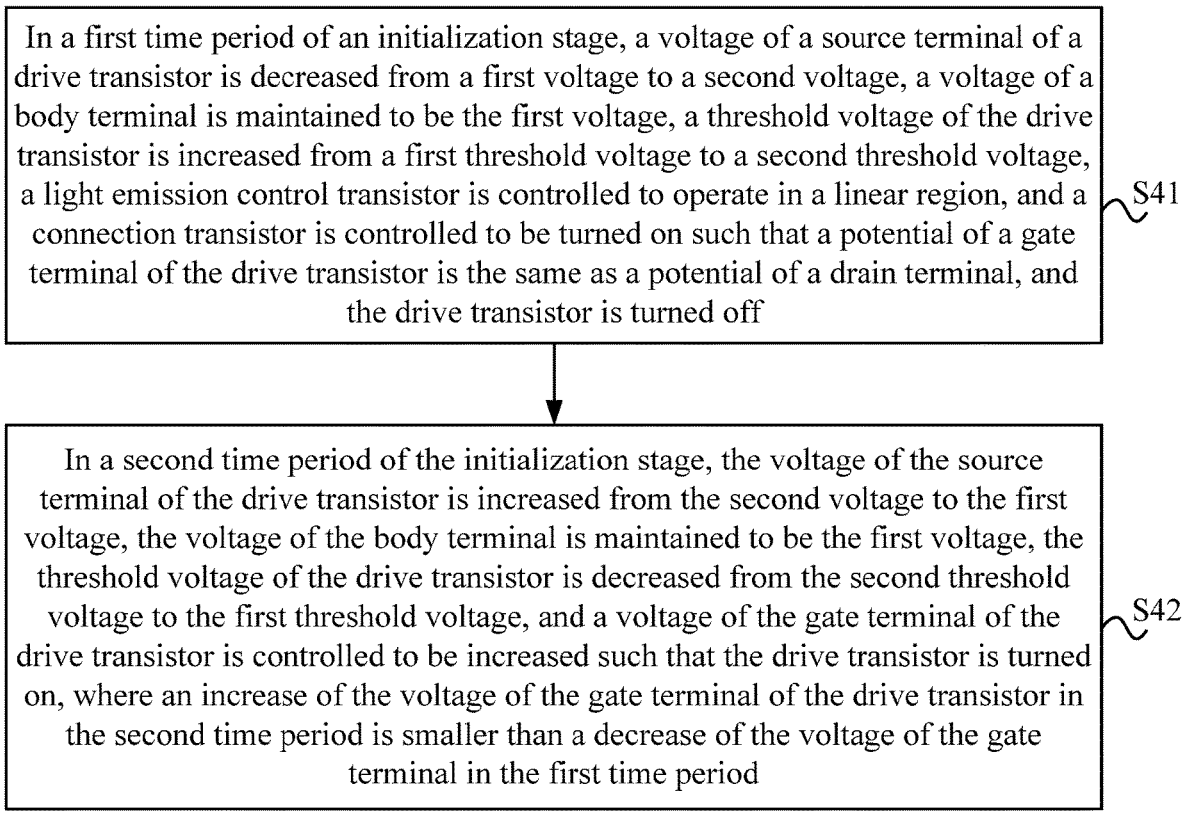
FIG. 12 is a flowchart of another method for driving a pixel circuit according to an embodiment of the present disclosure.

Further, FIG. 12 is a flowchart of another method for driving a pixel circuit according to an embodiment of the present disclosure. Referring to FIGS. 4 and 12, the method specifically includes steps described below.

In step S41, in the first time period of the initialization stage, the voltage of the source terminal of the drive transistor is decreased from the first voltage to the second voltage, the voltage of the body terminal is maintained to be the first voltage, the threshold voltage of the drive transistor is increased from the first threshold voltage to the second threshold voltage, the light emission control transistor is controlled to operate in a linear region, and the connection transistor is controlled to be turned on such that the potential of the gate terminal of the drive transistor is the same as the potential of the drain terminal, and the drive transistor is turned off.

In step S42, in the second time period of the initialization stage, the voltage of the source terminal of the drive transistor is increased from the second voltage to the first voltage, the voltage of the body terminal is maintained to be the first voltage, the threshold voltage of the drive transistor is decreased from the second threshold voltage to the first threshold voltage, and the voltage of the gate terminal of the drive transistor is controlled to be increased such that the drive transistor is turned on, where the increase of the voltage of the gate terminal of the drive transistor in the second time period is smaller than the decrease of the voltage of the gate terminal in the first time period.

Optionally, in the first time period, after the voltage of the source terminal of the drive transistor is decreased from the first voltage to the second voltage, the connection transistor delays being turned on.

Optionally, in the first time period, when the voltage of the source terminal of the drive transistor is decreased from the first voltage to the second voltage, the voltage of the first terminal of the first capacitor is decreased from the first voltage to the second voltage or is maintained to be the first voltage.

As shown in FIGS. 4 and 9 to 12, the specific working process of the method for driving a pixel circuit provided by the embodiments of the present disclosure further includes a threshold detection stage T2, a data writing stage T3, and a light emission stage T4 after the initialization stage T1.

At the threshold detection stage T2, a first switch control signal RST is at a logic low level, a second switch control signal XRST is at a logic high level, a first scan signal SCAN1 outputted from a first scan line is at the logic low level, a second scan signal SCAN2 outputted from a second scan line is at the logic low level, and a light emission control signal EMIT outputted from a light emission control signal line is at the logic high level so that the connection transistor M1 and the data writing transistor M3 are turned on, the light emission control transistor M2 is turned off, and the drive transistor MD is a diode connection structure. The gate terminal N1 of the drive transistor MD is charged by the first voltage V1, that is, a power voltage ELVDD for light emission and display, through the drive transistor MD and the connection transistor M1 so that the potential of the gate terminal N1 is increased until the potential of the gate terminal N1 is ELVDD−|Vth|. Thus, the drive transistor MD is turned off, and the voltage of the gate terminal N1 is stored in the first capacitor C1 and the second capacitor C2. The stored voltage includes threshold information of the drive transistor MD so that the threshold voltage Vth of the drive transistor MD is detected.

At the data writing stage T3, the first switch control signal RST is at the logic low level, the second switch control signal XRST is at the logic high level, the first scan signal SCAN1 outputted from the first scan line is at the logic low level, the second scan signal SCAN2 outputted from the second scan line is at the logic high level, and the light emission control signal EMIT outputted from the light emission control signal line is at the logic high level so that a first switch transistor M31 and the data writing transistor M3 are turned on, and a second switch transistor M32, the connection transistor M1, and the light emission control transistor M2 are turned off. At this time, a data line Data is configured to transmit a data voltage. Under the voltage division effect of the first capacitor C1 and the second capacitor C2, the potential of the gate terminal N1 of the drive transistor MD becomes $$V_{N1} = ELVDD - |V_{th}| - (V_{data} - V_{ofs}) \times \left(\frac{c1}{c1 + c2}\right).$$

$V_{data}$ denotes the data voltage, $V_{ofs}$ denotes a fixed voltage transmitted by the data line Data, c1 denotes a capacitance value of the first capacitor C1, and c2 denotes a capacitance value of the second capacitor C2.

In this embodiment, after the data voltage $V_{data}$ corresponding to a to-be-displayed grayscale is divided by the first capacitor C1 and the second capacitor C2, a lower voltage is written to the gate terminal N1 so that the data voltage $V_{data}$ is written within a wider range and gamma adjustment is performed within a wider range.

At the light emission stage T4, the first switch control signal RST is at the logic low level, the second switch control signal XRST is at the logic high level, the first scan signal SCAN1 outputted from the first scan line is at the logic high level, the second scan signal SCAN2 outputted from the second scan line is at the logic high level, and the light emission control signal EMIT outputted from the light emission control signal line is at the logic low level so that the first switch transistor M31 and the light emission control transistor M2 are turned on, and the second switch transistor M32, the connection transistor M1, and the data writing transistor M3 are turned off. The drive transistor MD generates a light emission current $I_{OLED}$ to drive the light-emitting element OLED to emit light. The light emission current $I_{OLED}$ may be expressed as follows:

$$I_{OLED} = \frac{1}{2}\mu C_{OX}\frac{W_P}{L_P}\left(ELVDD - ELVDD + |V_{th}| - |V_{th}| + (V_{data} - V_{ofs}) \times \left(\frac{c1}{c1 + c2}\right)\right)^2 = \frac{1}{2}\mu C_{OX}\frac{W_P}{L_P}\left((V_{data} - V_{ofs}) \times \left(\frac{c1}{c1 + c2}\right)\right)^2.$$

μ denotes a carrier mobility of the drive transistor MD, Cox denotes a capacitance of an oxide layer of the drive transistor MD per unit area, and $W_P/L_P$ denotes a width-to-length ratio of the drive transistor MD.

As can be seen from the above formula, the light emission current $I_{OLED}$ of the pixel circuit is independent of the threshold voltage Vth of the drive transistor MD and the first voltage V1 transmitted on the power line so that an effect of IR-Drop of the threshold voltage and the first voltage V1 is compensated for, and all pixels are driven by the same current to emit light, ensuring the uniformity of the current, improving display uniformity, and facilitating the improvement of the display effect.

Figure 13:
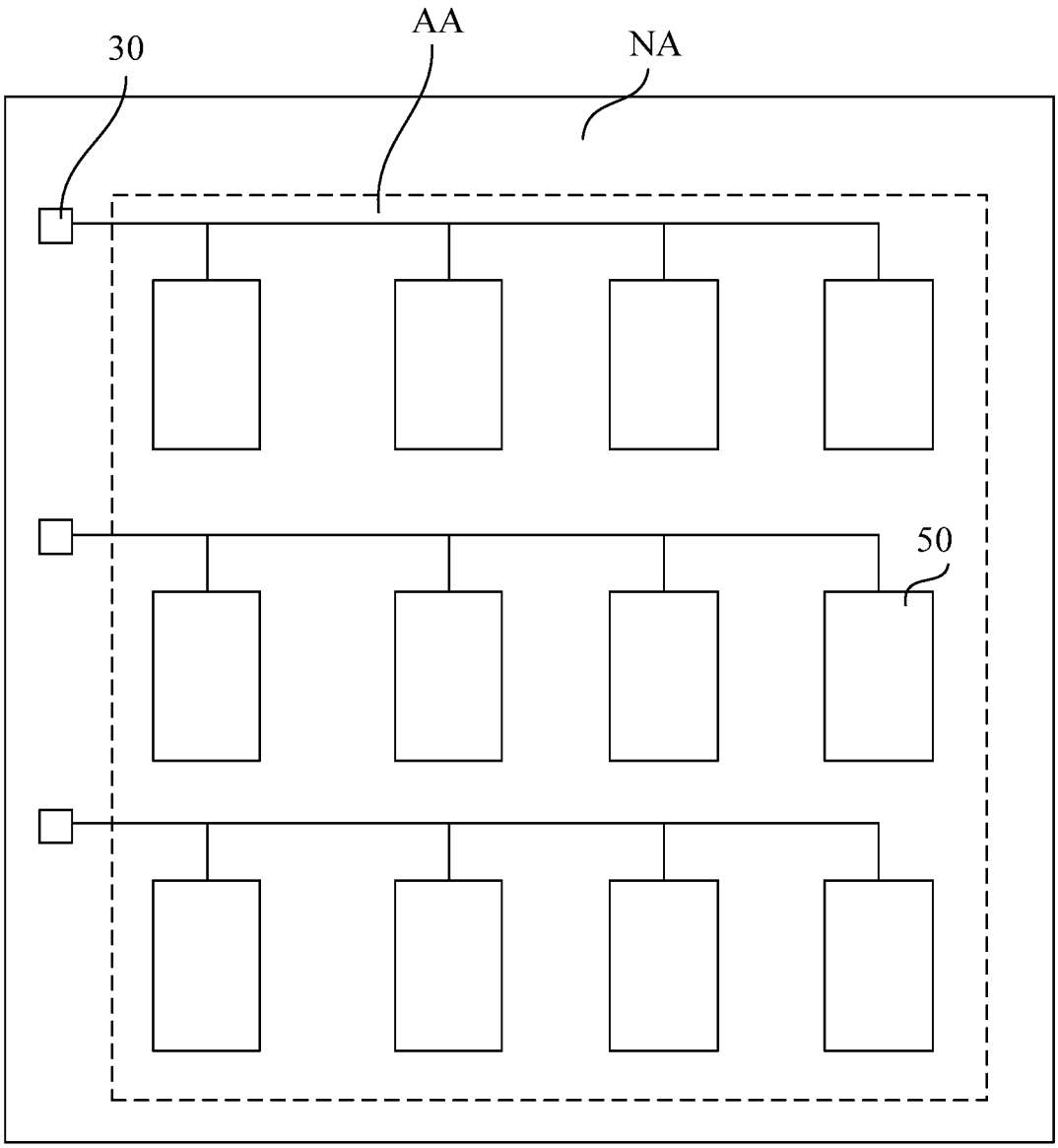
FIG. 13 is a top view of a display panel according to an embodiment of the present disclosure.

Optionally, the embodiments of the present disclosure further provide a display panel. FIG. 13 is a top view of a display panel according to an embodiment of the present disclosure. Referring to FIG. 13, the display panel includes a display region AA and a non-display region NA surrounding the display region AA, where a plurality of pixels 50 are arranged in a matrix in the display region AA, and a voltage gating circuit 30 is disposed in the non-display region NA. The voltage gating circuit 30 does not occupy any area of a display region of a pixel, which is conducive to reducing an area occupied by the pixel and improving the PPI of the display panel. Therefore, the display panel can be better applied to a display device having a small size and a high resolution such as 4K.

Optionally, a plurality of pixels 50 in the same row share the voltage gating circuit 30. In the display region AA, a plurality of rows of pixels are included, and pixels in each row share one voltage gating circuit 30, improving the integrity of the display panel and reducing a design difficulty of a control chip.

Optionally, the display panel in the embodiments of the present disclosure is a silicon-based organic light-emitting micro display panel. The silicon-based organic light-emitting micro display panel uses single crystal silicon as a substrate and has a substrate effect. According to the technical solutions of the present disclosure, a potential of a gate terminal of a drive transistor may be controlled to be decreased through a threshold hysteresis effect, thereby initializing the potential of the gate terminal of the drive transistor. In the initialization process, the drive transistor is in an off state, and no current flows through the drive transistor. Therefore, the power consumption of a pixel circuit can be reduced, thereby reducing the power consumption of the display panel. Additionally, the pixel circuit provided by the embodiments of the present disclosure does not need to be provided with an initialization transistor, reducing the number of transistors and facilitating the improvement of PPI.

It is to be noted that the display panel provided by the embodiments of the present disclosure may be used in electronic products such as mobile phones, PADs, notebook computers, vehicle-mounted devices, and smart wearable devices. The display panel includes the pixel circuit provided in any one of the embodiments of the present disclosure, so the display panel also has the beneficial effects described in any one of the embodiments described above.

It is to be noted that the preceding are only preferred embodiments of the present disclosure and technical principles used therein. It is to be understood by those skilled in the art that the present disclosure is not limited to the embodiments described herein. Those skilled in the art can make various apparent modifications, adaptations, and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A pixel circuit, comprising a drive transistor, wherein the drive transistor comprises a gate terminal, a source terminal, a drain terminal, and a body terminal;

wherein the source terminal of the drive transistor is connected to a first power line, the body terminal of the drive transistor is connected to a second power line, and the gate terminal of the drive transistor is connected to a gate potential control circuit;

wherein the first power line is configured to provide a first voltage or a second voltage, and the first voltage is higher than the second voltage; and wherein the second power line is configured to provide the first voltage;

wherein an initialization stage of the pixel circuit comprises a first time period and a second time period; wherein in the first time period, a voltage provided by the first power line is decreased from the first voltage to the second voltage, a threshold voltage of the drive transistor is increased from a first threshold voltage to a second threshold voltage, and the gate potential control circuit controls a voltage of the gate terminal to be decreased such that the drive transistor is turned off;

wherein in the second time period, the voltage provided by the first power line is increased from the second voltage to the first voltage, the threshold voltage of the drive transistor is decreased from the second threshold voltage to the first threshold voltage, and the gate potential control circuit controls the voltage of the gate terminal of the drive transistor to be increased such that the drive transistor is turned on;

wherein an increase of the voltage of the gate terminal of the drive transistor in the second time period is smaller than a decrease of the voltage of the gate terminal in the first time period.

2. The pixel circuit according to claim 1, wherein the gate potential control circuit comprises a first capacitor and a connection transistor;

wherein a second terminal of the first capacitor and a first electrode of the connection transistor are connected to the gate terminal of the drive transistor, and a second electrode of the connection transistor is connected to the drain terminal of the drive transistor; and wherein in the first time period, the gate potential control circuit controls a potential of the gate terminal of the drive transistor to be the same as a potential of the drain terminal of the drive transistor.

3. The pixel circuit according to claim 1, wherein the first voltage is a power voltage for light emission and display of the pixel circuit.

4. The pixel circuit according to claim 1, further comprising a voltage gating circuit configured to gate the first voltage or the second voltage transmitted by the first power line;

wherein the voltage gating circuit comprises a first switch transistor and a second switch transistor;

wherein the first switch transistor comprises a first terminal for receiving the first voltage, a second terminal connected to the first power line, and a control terminal connected to a first switch control signal line; and the second switch transistor comprises a first terminal for receiving the second voltage, a second terminal connected to the first power line, and a control terminal connected to a second switch control signal line.

5. The pixel circuit according to claim 4, wherein a pulse of a second switch control signal is located within an interval where a pulse of a first switch control signal is located.

6. The pixel circuit according to claim 2, wherein a first terminal of the first capacitor is connected to the first power line; or a first terminal of the first capacitor is connected to the second power line providing the fixed first voltage.

7. The pixel circuit according to claim 2, further comprising a light emission control transistor, a light-emitting element, a second capacitor, and a data writing transistor;

wherein the light emission control transistor comprises a first electrode connected to the drain terminal and a second electrode connected to an anode of the light-emitting element;

wherein the second capacitor comprises a first terminal connected to the gate terminal and a second terminal connected to a first electrode of the data writing transistor, and a fixed voltage signal is input to a second electrode of the data writing transistor at the initialization stage.

8. The pixel circuit according to claim 7, wherein at the initialization stage, the light emission control transistor operates in a cutoff region, a saturation region, or a linear region.

9. The pixel circuit according to claim 7, wherein in the first time period, after the voltage provided by the first power line is decreased from the first voltage to the second voltage, the connection transistor delays being turned on such that the potential of the gate terminal of the drive transistor is the same as the potential of the drain terminal of the drive transistor.

10. The pixel circuit according to claim 7, wherein in the first time period, after the voltage provided by the first power line is decreased from the first voltage to the second voltage, the data writing transistor delays being turned on such that the potential of the gate terminal of the drive transistor is decreased.

11. A display panel, comprising the pixel circuit according to clam 1.

12. The display panel according to claim 11, wherein the display panel comprises a display region and a non-display region surrounding the display region, and the pixel circuit further comprises a voltage gating circuit disposed in the non-display region and configured to gate a first voltage or a second voltage transmitted by a first power line;

wherein a plurality of pixels in a same row share the voltage gating circuit.

13. The display panel according to claim 11, wherein the display panel is a silicon-based organic light-emitting micro display panel.

14. A method for driving a pixel circuit, wherein the pixel circuit comprises a drive transistor, wherein the drive transistor comprises a gate terminal, a source terminal, a drain terminal, and a body terminal;

wherein the source terminal of the drive transistor is connected to a first power line, the gate terminal of the drive transistor is connected to a gate potential control circuit, and the first power line is configured to provide a first voltage or a second voltage;

wherein the first voltage is higher than the second voltage, and a second power line is configured to provide the fixed first voltage;

wherein the method for driving a pixel circuit comprises:

an initialization stage of the pixel circuit comprising a first time period and a second time period;

in the first time period, decreasing a voltage of the source terminal of the drive transistor from the first voltage to the second voltage, maintaining a voltage of the body terminal to be the first voltage, increasing a threshold voltage of the drive transistor from a first threshold voltage to a second threshold voltage, and controlling, by the gate potential control circuit, a voltage of the gate terminal to be decreased such that the drive transistor is turned off; and in the second time period, increasing the voltage of the source terminal of the drive transistor from the second voltage to the first voltage, maintaining the voltage of the body terminal to be the first voltage, decreasing the threshold voltage of the drive transistor from the second threshold voltage to the first threshold voltage, and controlling, by the gate potential control circuit, the voltage of the gate terminal of the drive transistor to be increased such that the drive transistor is turned on;

wherein an increase of the voltage of the gate terminal of the drive transistor in the second time period is smaller than a decrease of the voltage of the gate terminal in the first time period such that the gate terminal is initialized.

15. The method for driving a pixel circuit according to claim 14, wherein the gate potential control circuit comprises a first capacitor and a connection transistor, a second terminal of the first capacitor and a first electrode of the connection transistor are connected to the gate terminal of the drive transistor, and a second electrode of the connection transistor is connected to the drain terminal of the drive transistor;

wherein the method for driving a pixel circuit comprises:

in the first time period, controlling, by the gate potential control circuit, a potential of the gate terminal of the drive transistor to be the same as a potential of the drain terminal of the drive transistor.

16. The method for driving a pixel circuit according to claim 15, wherein the pixel circuit further comprises a light emission control transistor and a light-emitting element;

wherein the light emission control transistor comprises a first electrode connected to the drain terminal of the drive transistor and a second electrode connected to an anode of the light-emitting element;

wherein the method for driving a pixel circuit comprises:

in the first time period, controlling the light emission control transistor to operate in a cutoff region and the connection transistor to be turned on such that the potential of the gate terminal of the drive transistor is the same as the potential of the drain terminal of the drive transistor.

17. The method for driving a pixel circuit according to claim 15, wherein the pixel circuit further comprises a light emission control transistor and a light-emitting element;

wherein the light emission control transistor comprises a first electrode connected to the drain terminal of the drive transistor and a second electrode connected to an anode of the light-emitting element;

wherein the method for driving a pixel circuit comprises:

in the first time period, controlling the light emission control transistor to operate in a saturation region such that the drain terminal of the drive transistor is discharged through the light emission control transistor, and controlling the connection transistor to operate in a linear region such that the potential of the gate terminal of the drive transistor is the same as the potential of the drain terminal of the drive transistor.

18. The method for driving a pixel circuit according to claim 15, wherein the pixel circuit further comprises a light emission control transistor and a light-emitting element;

wherein the light emission control transistor comprises a first electrode connected to the drain terminal of the drive transistor and a second electrode connected to an anode of the light-emitting element;

wherein the method for driving a pixel circuit comprises:

in the first time period, controlling the light emission control transistor to operate in a linear region such that a voltage difference between the drain terminal of the drive transistor and the anode of the light-emitting element is a threshold voltage of the light-emitting element, and controlling the connection transistor to be turned on such that the potential of the gate terminal of the drive transistor is the same as the potential of the drain terminal of the drive transistor.

19. The method for driving a pixel circuit according to claim 14, wherein in the first time period, when the voltage of the source terminal of the drive transistor is decreased from the first voltage to the second voltage, a voltage of a first terminal of a first capacitor is decreased from the first voltage to the second voltage or is maintained to be the first voltage.

20. The method for driving a pixel circuit according to claim 14, further comprising a threshold detection stage, a data writing stage, and a light emission stage after the initialization stage.

* * * * *